US005582241A

United States Patent [19]

Yoho et al.

[11] Patent Number: 5,582,241

[45] Date of Patent: Dec. 10, 1996

[54] HEAT EXCHANGING FINS WITH FLUID CIRCULATION LINES THEREWITHIN

[76] Inventors: Robert W. Yoho, 5812 Toucan Pl., Clearwater, Fla. 34620; Jose M. Moratalla, P.O. Box 2603, Dunedin, Fla. 34697-2603

[21] Appl. No.: 195,398

[22] Filed: Feb. 14, 1994

[51] Int. Cl.[6] ..... F28D 1/03

[52] U.S. Cl. ..... 165/81; 165/149; 165/153

[58] Field of Search ..... 165/81, 149, 153, 165/167, 175

[56] References Cited

U.S. PATENT DOCUMENTS

| | | | |
|---|---|---|---|
| 1,834,001 | 12/1931 | Modine | 165/149 X |
| 3,207,216 | 9/1965 | Donaldson | 165/148 |
| 3,757,855 | 9/1973 | Kun et al. | 165/166 |
| 4,470,455 | 9/1984 | Sacca | 165/167 |
| 4,846,268 | 7/1989 | Beldam | 165/153 |
| 5,036,911 | 8/1991 | So et al. | 165/153 |
| 5,125,452 | 6/1992 | Yamauchi et al. | 165/133 |
| 5,369,883 | 12/1994 | So et al. | 29/896.039 |

*Primary Examiner*—Allen J. Flanigan

[57] ABSTRACT

A conduit for use in directing the flows of primary fluid and a secondary fluid in heat exchanging relationships comprising a plurality of elongated members to direct a flow of a primary fluid in a first path. The first path is comprised of separate generally parallel channels. It includes means to direct a flow of air over, under and between the plurality of elongated members in a second path. The first path and the second path are in spaced alternating relationship in generally parallel planes and with the first path in a first direction and the secondary path in a second direction perpendicular to the first direction. Coupling means are associated with the input and output ends of the first and second paths whereby when a first fluid is fed through the first paths at a first temperature and a second fluid is fed through the second paths at a second temperature, a heat transfer occurs therebetween.

6 Claims, 31 Drawing Sheets

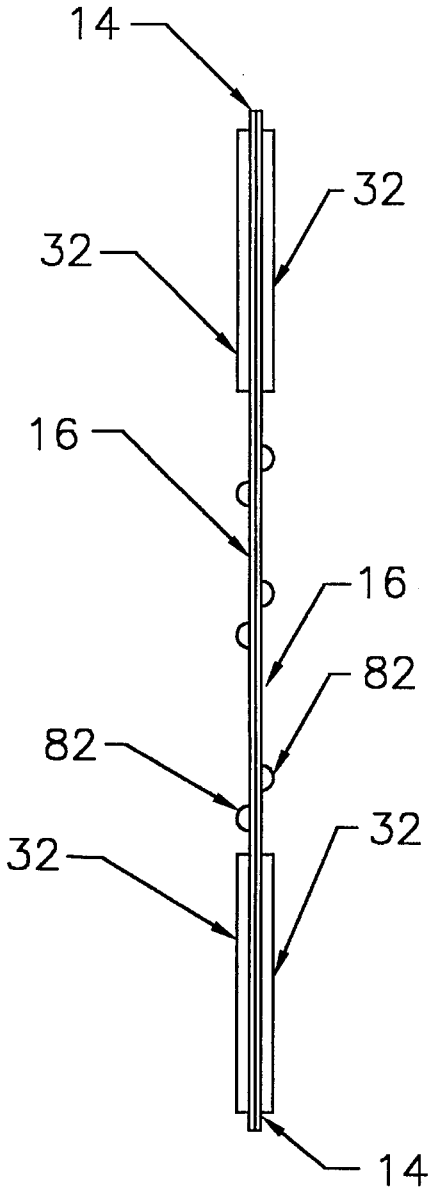
FIG. 10
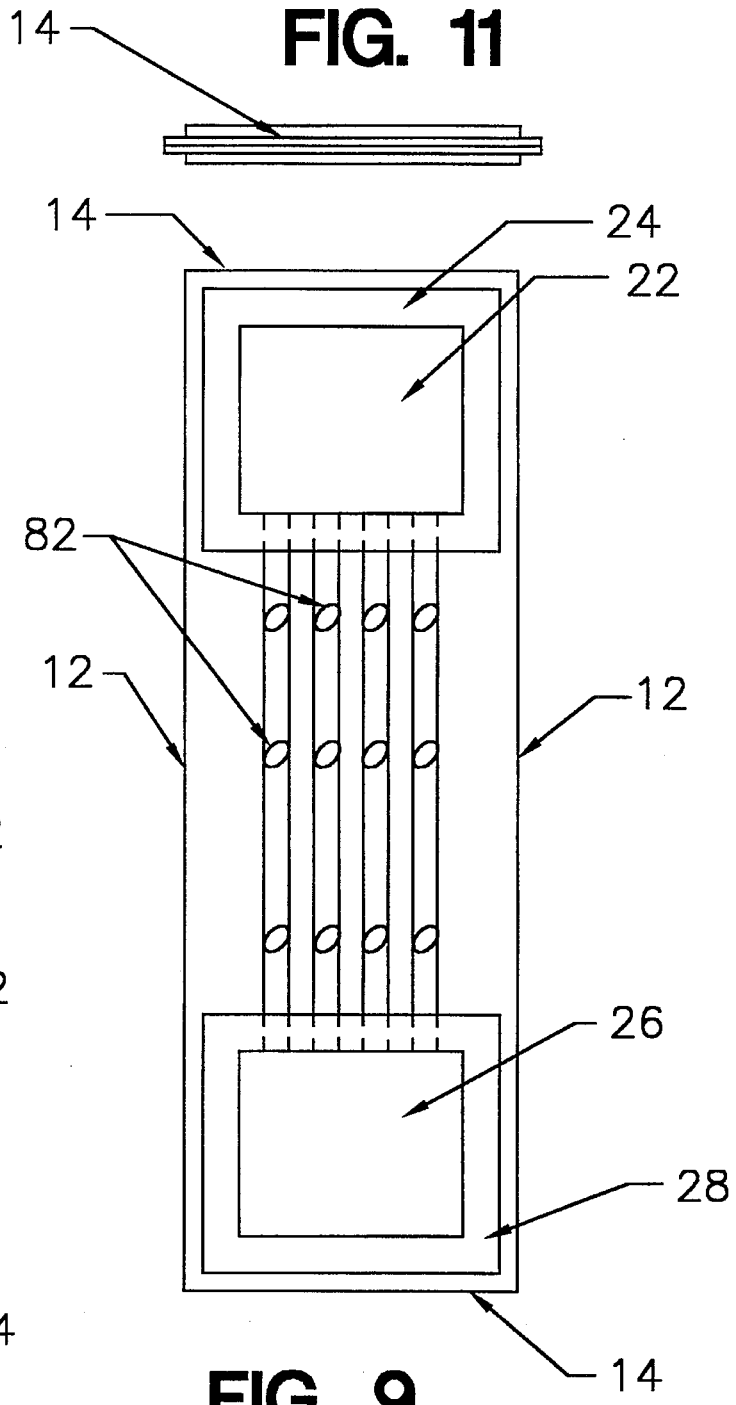
FIG. 11
FIG. 9

FIG. 20
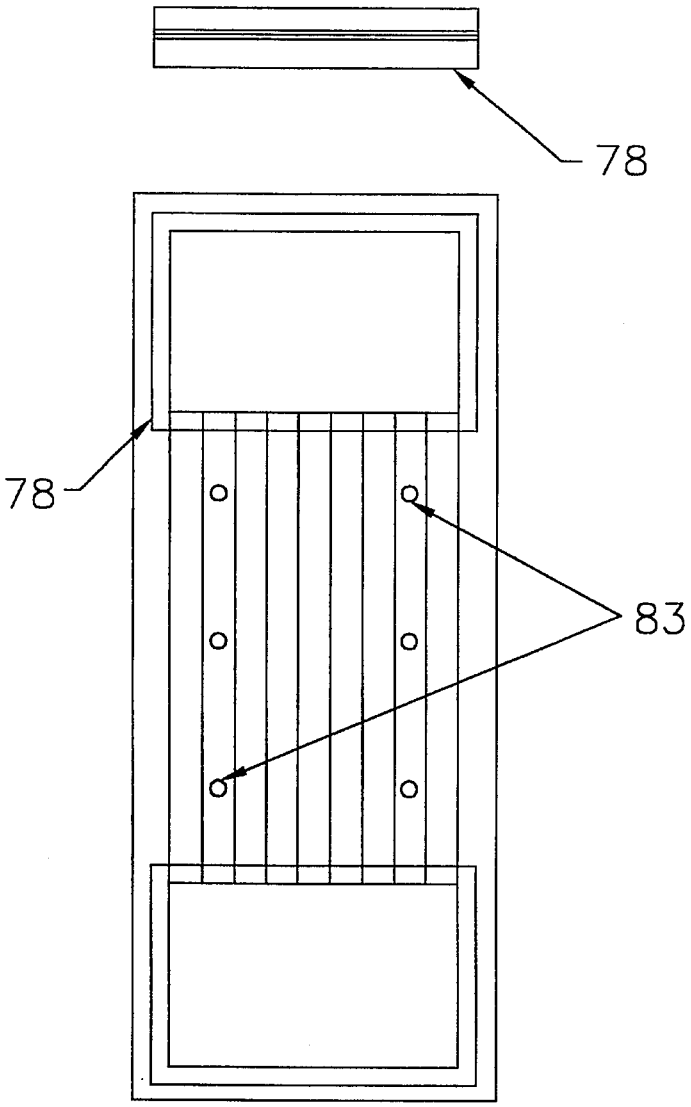
FIG. 18
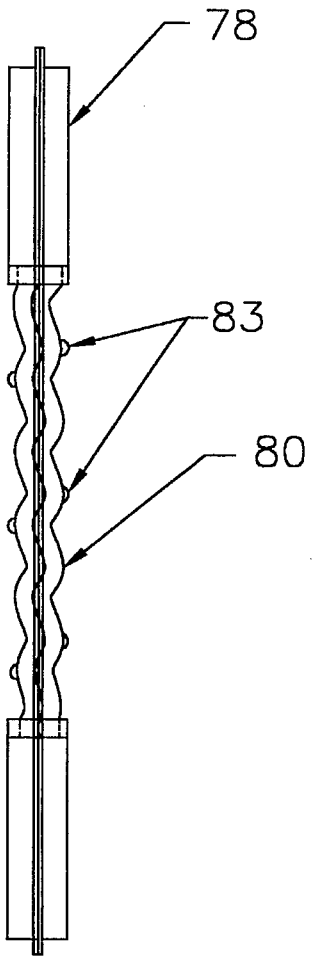
FIG. 19

FIG. 27
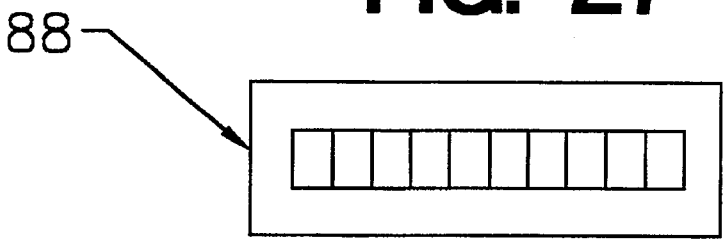
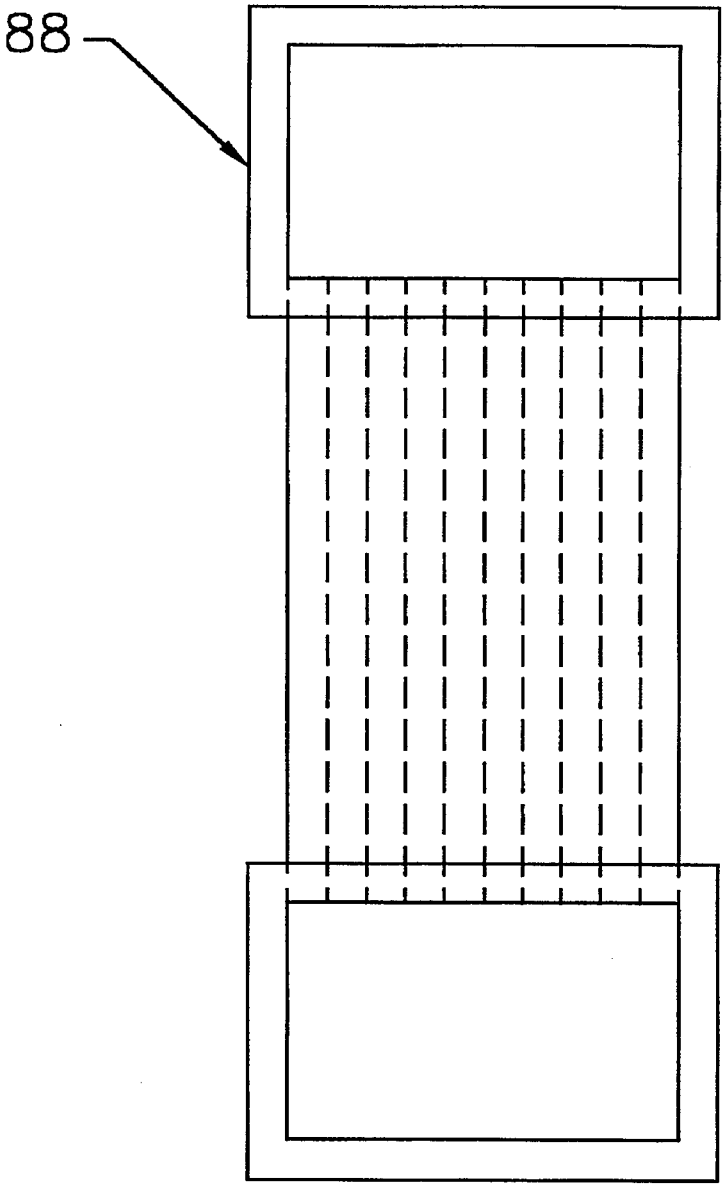
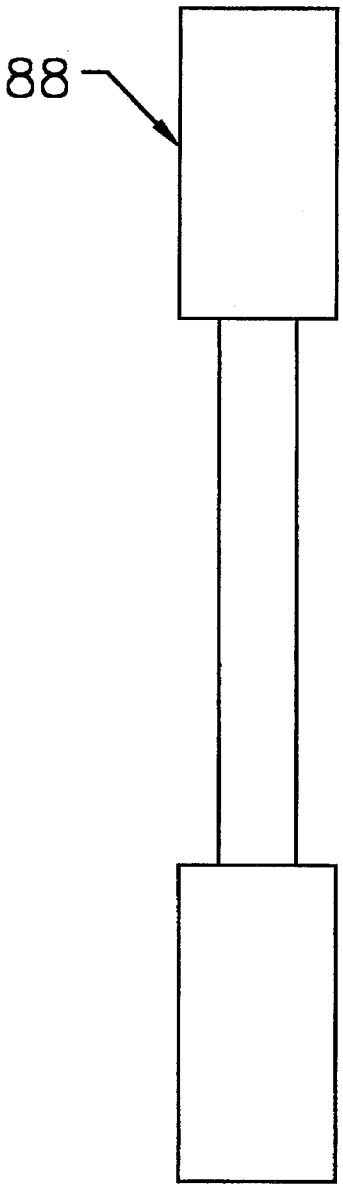
FIG. 25
FIG. 26

HEAT EXCHANGING FINS WITH FLUID CIRCULATION LINES THEREWITHIN

BACKGROUND OF THE INVENTION

1. Field of the Invention

This invention relates to heat exchanging fins with fluid circulation lines therewithin and, more particularly, to air conditioning assemblies wherein the heat exchangers include fins having internal lines (flutes/pipes/tubes) for the circulation of heat exchanging fluids.

2. Description of the Background Art

Presently, air conditioning devices employ heat exchangers in various locations. Such heat exchangers normally involve a tube configured in a serpentine fashion for the passage of a heat transfer fluid therethrough. Thermally conductive fins are secured to the tube to provide extended surfaces for effecting the exchange of heat between one fluid in one flow path within the tube and another fluid in another flow path across the fins. Such is conventional throughout the industry. Unfortunately, however, a relatively limited area of contact exists between the tube conveying the first fluid and the second fluid moved in heat exchanging relationship therewith. The fins supplement the heat exchanging relationship to an extent but such extent is limited even through it is normally accepted within the industry.

Nowhere in the prior art is there a disclosure, teaching or suggestion that fluid conveying tubes could be configured in such manner as to constitute the fins themselves. Nowhere in the prior art is there a disclosure, teaching or suggestion that fluid conveying tubes and fins could be consolidated as a single entity for maximizing the area of contact between the two media moving in heat exchanging relationship. Nowhere in the prior art is there a disclosure, teaching or suggestion for optimizing the efficiency of heat exchanging assemblies in air conditioners and the like.

Therefore, it is an object of the present invention to provide an improvement which overcomes the aforementioned inadequacies of the prior art devices and provides an improvement which is a significant contribution to the advancement of the heat exchanger art.

Another object of the present invention is to convey a first fluid through a plurality of small lines within the fins of the heat exchanger and to effect the flow of a second fluid across such lines and fins.

Another object of the present invention is to optimize the heat transfer capabilities in air conditioners and other devices of the type which normally employ heat exchangers with thermally conductive surfaces.

A further object of the present invention is to transfer heat from fluid in one path to another fluid in another path.

Another object of the present invention is to provide a conduit for use in directing the flows of primary fluid and a secondary fluid in heat exchanging relationships comprising a plurality of elongated members to direct a flow of a primary fluid in a first path. The first path is comprised of separate generally parallel channels. It includes means to direct a flow of a secondary fluid over, under and between the plurality of elongated members in a second path. The first path and the second path are in spaced alternating relationship in generally parallel planes and with the first path in a first direction and the secondary path in a second direction perpendicular to the first direction. Coupling means are adapted to be associated with the input and output ends of the first and second paths whereby when a first fluid is fed through the first paths at a first temperature and a second fluid is fed through the second paths at a second temperature, a heat transfer occurs therebetween.

The foregoing has outlined some of the pertinent objects of the invention. These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a conduit for use in directing the flows of a primary fluid and a secondary fluid in heat exchanging relationship. The assembly includes a vertically positionable elongated member having long parallel side edges and short parallel upper and lower end edges, and generally parallel exterior faces therebetween. The elongated member is formed of two similarly configured parts of similar construction permanently coupled around their peripheries. The assembly also includes a header aperture extending through the member from face to face adjacent to the upper end edge, and a footer aperture extending through the member from face to face adjacent to the lower end edge. The apertures have planar parallel peripheral surfaces at opposing ends at a first predetermined distance. The planar peripheral surfaces are attachable with planar peripheral surfaces of other similarly configured elongated members to define a first flow path for the primary fluid. The assembly also includes a plurality of essentially parallel coupling linear extents securing together the parts between the header aperture and the footer aperture to define parallel linear paths for the primary fluid moving in the first path from the header to the footer aperture. The parts are secured together along the coupling lines and their peripheries whereby the exterior surfaces of the facing parts are at a second predetermined distance less than the first predetermined distance. The assembly further includes spacer members formed in the exterior surfaces of the facing parts and extending outwardly to a distance whereby when a plurality of elongated members are coupled at their apertures, spaces will be formed between the exterior surfaces of the coupled elongated members to define a second path for the second fluid perpendicular to the first path for the first fluid so that when a first fluid of a first temperature is flowed in the first path and a second fluid of a second temperature is flowed in the second path, a heat exchange will occur therebetween.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 2 illustrates a conventional heat exchanger with fan coils of the type shown in FIG. 1 which may be used for heating and/or cooling. FIG. 3 is an indirect evaporative cooling unit employing conventional heat exchanges. FIG. 4 is a cooling assembly with a desiccant wheel and conventional heat exchangers. FIG. 5 is a perspective illustration of a cooling unit with a desiccant wheel and convention heat exchangers. These Figures are illustrative of assemblies wherein the heat exchangers of the present invention may be used as a substitute for known heat exchangers.

FIGS. 6 through 14 illustrate the primary embodiment of the invention, FIG. 6 being an exploded perspective view of one component of the heat exchanger assembly, FIG. 7 being a perspective illustration of the FIG. 6 component in the assembled condition, FIG. 8 being a perspective illustration similar to FIG. 7 but with parts removed to shown certain internal constructions, FIGS. 9, 10 and 11 being a front and side and top elevational view of the component of FIGS. 6 through 8, FIG. 12 being an exploded perspective view of a plurality of components in assemblies configuration, FIG. 13 being the components of FIG. 12 assembled for operation and use, and FIG. 14 being an enlarged perspective showing of the spring coupling at the ends of the assembly.

FIGS. 15 through 21 illustrate a variation in the primary embodiment of the invention, FIG. 15 being an exploded perspective view of one component of the heat exchanger apparatus, FIG. 16 being a perspective illustration of the FIG. 15 component assembled, FIG. 17 being a perspective illustration similar to FIG. 16 but with parts removed to shown certain internal constructions, FIGS. 18, 19 and 20 being a front and side and top elevational view of the device of FIGS. 15 through 17, and FIG. 21 being an exploded perspective view of a plurality of components in assemblies configuration.

FIGS. 22 through 28 illustrate an alternate embodiment of the invention wherein the lines for the first fluid are extruded, FIG. 22 being an exploded perspective view of one component of the heat exchanger apparatus, FIG. 23 being a perspective illustration of the FIG. 22 component assembled, FIG. 24 being a perspective illustration similar to FIG. 23 but with parts removed to shown certain internal constructions, FIGS. 25, 26 and 27 being a front and side and top elevational view of the device of FIGS. 22 through 24, and FIG. 28 being an exploded perspective view of a plurality of components in assemblies configuration.

Similar reference characters refer to similar parts throughout the several views of the drawings.

DETAILED DESCRIPTION OF THE PREFERRED EMBODIMENT

Environment

Figure 1:
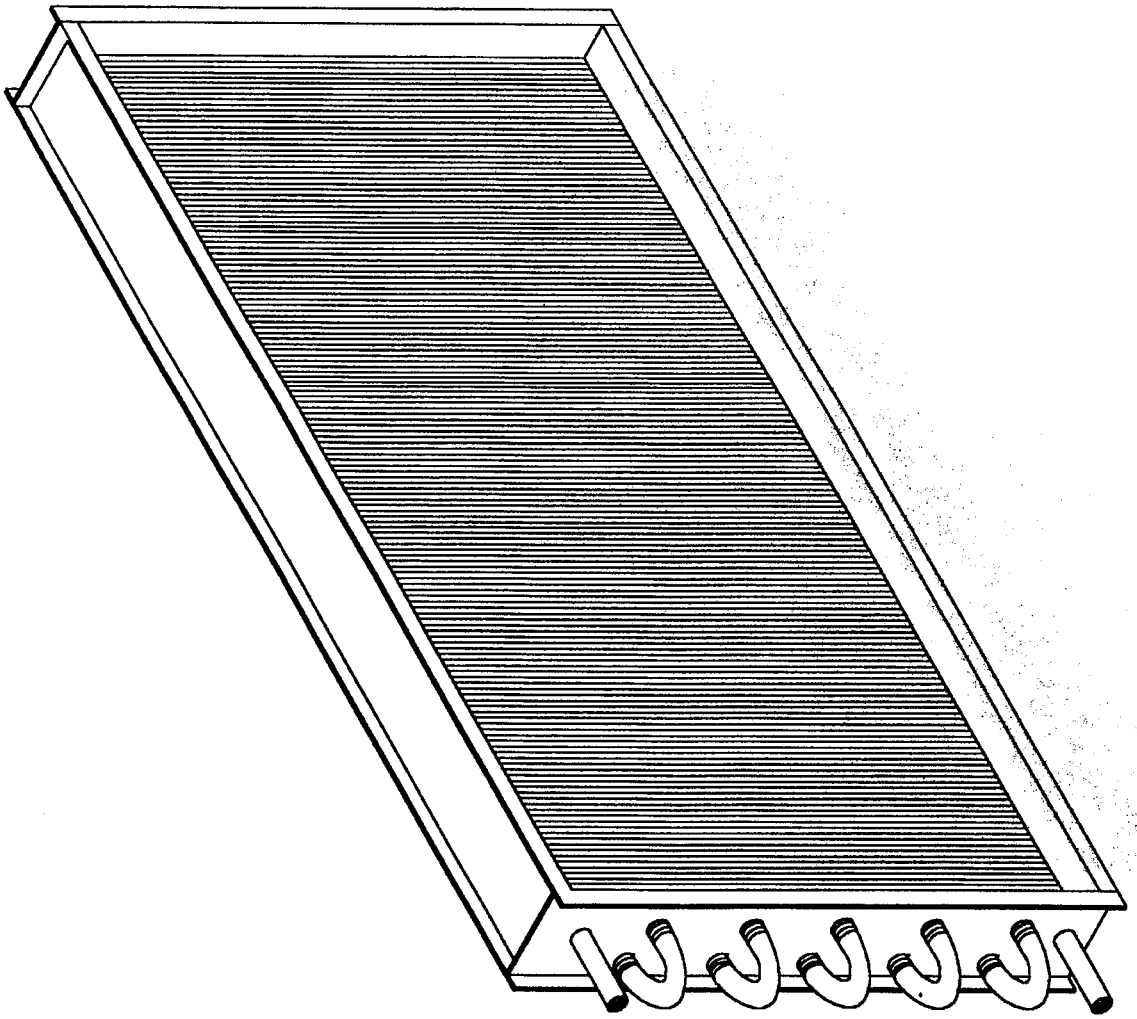
FIG. 1 is a conventional heat exchanger with a conventional coil of pipes conducting a first medium with thermally conductive fins in association therewith over which the second medium may pass.
Figure 2:
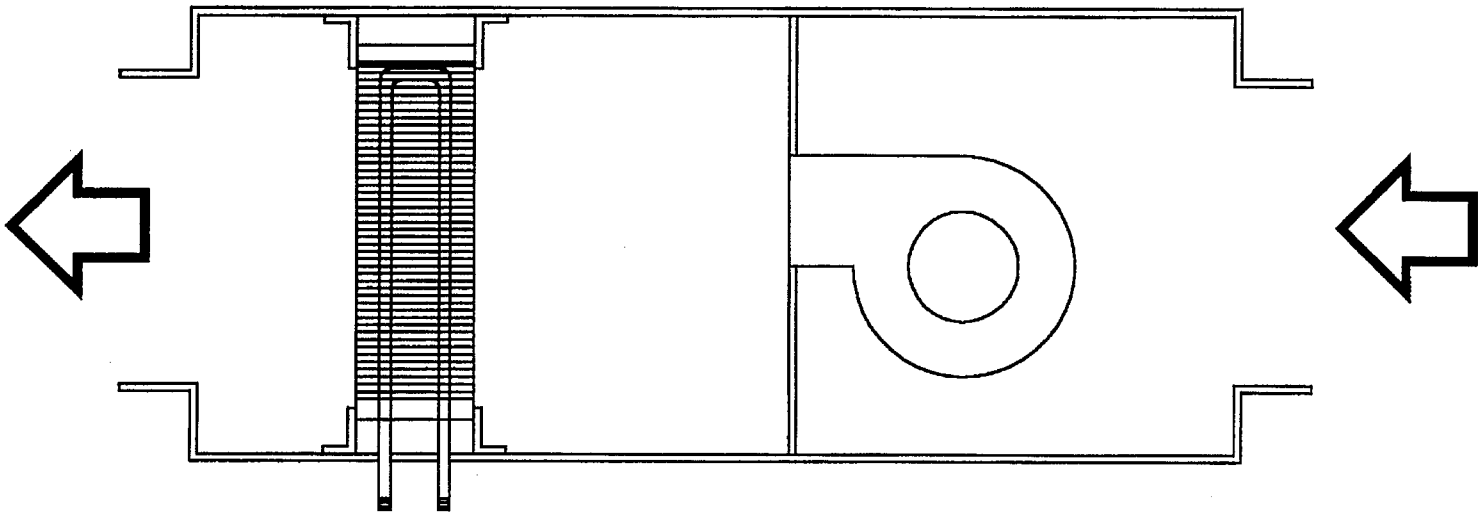
FIGS. 2 through 5 are assemblies wherein the conventional heat exchanger could be replaced by the heat exchangers of the present invention.
Figure 3:
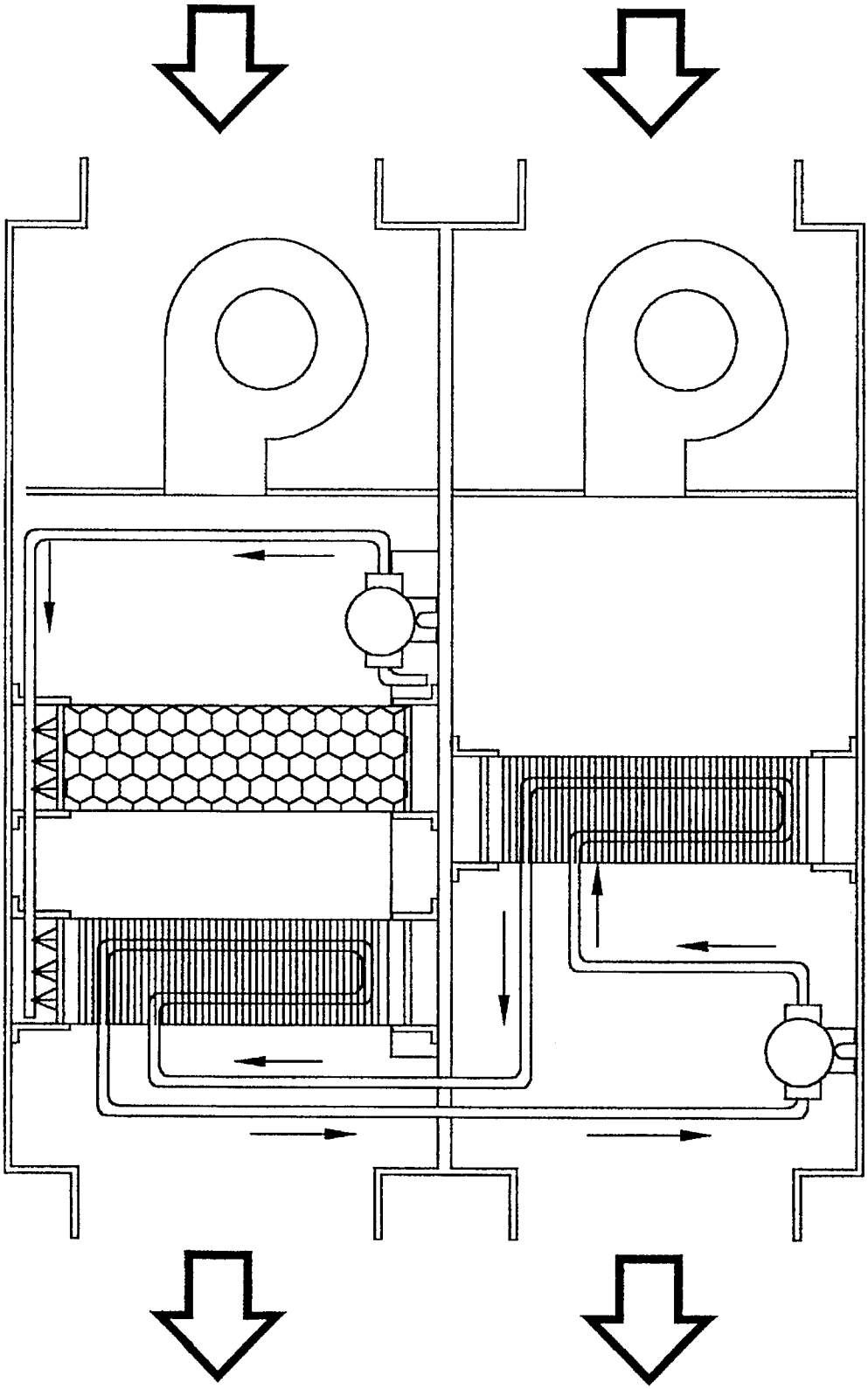
Figure 4:
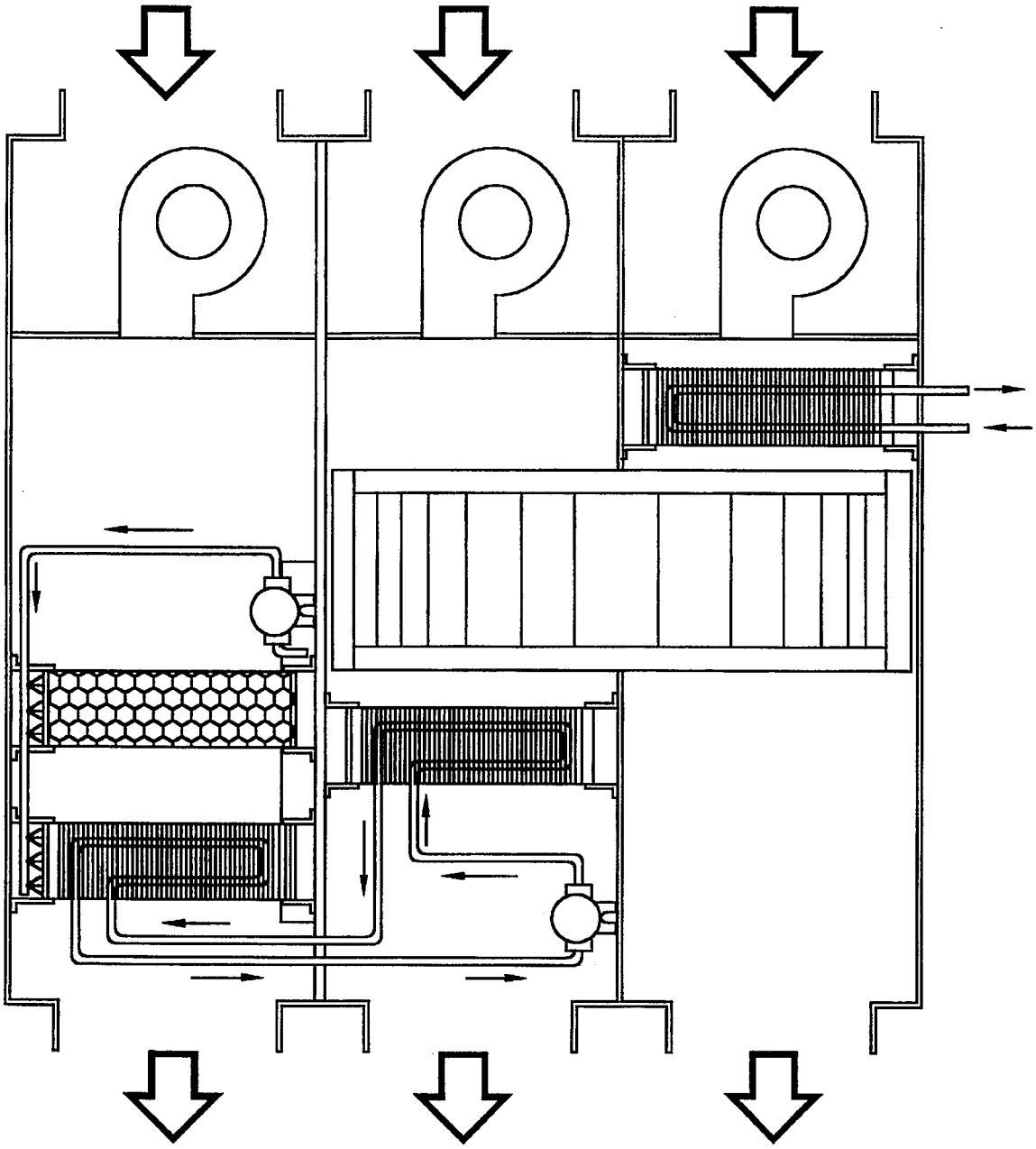
Figure 5:
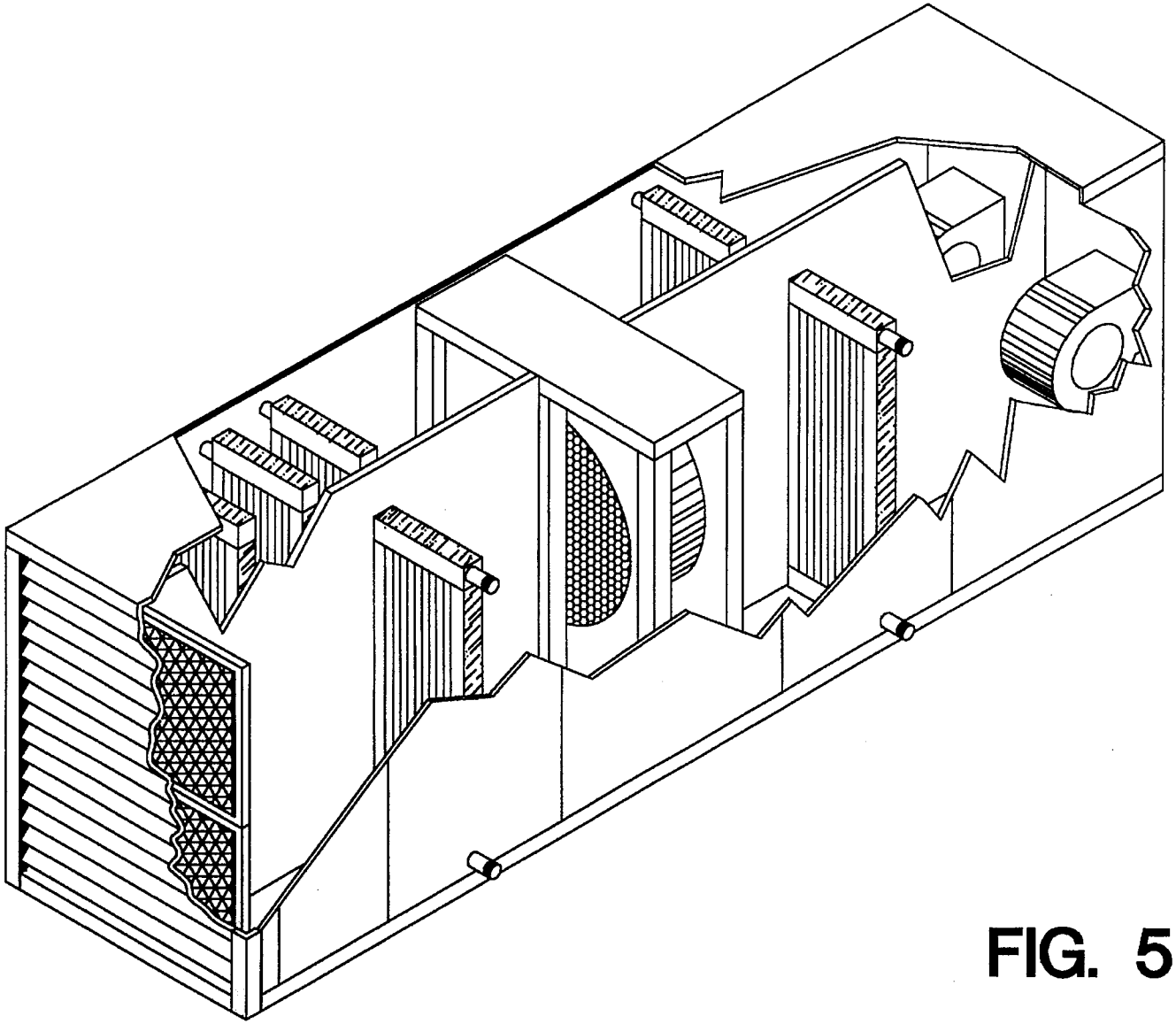
Figure 6:
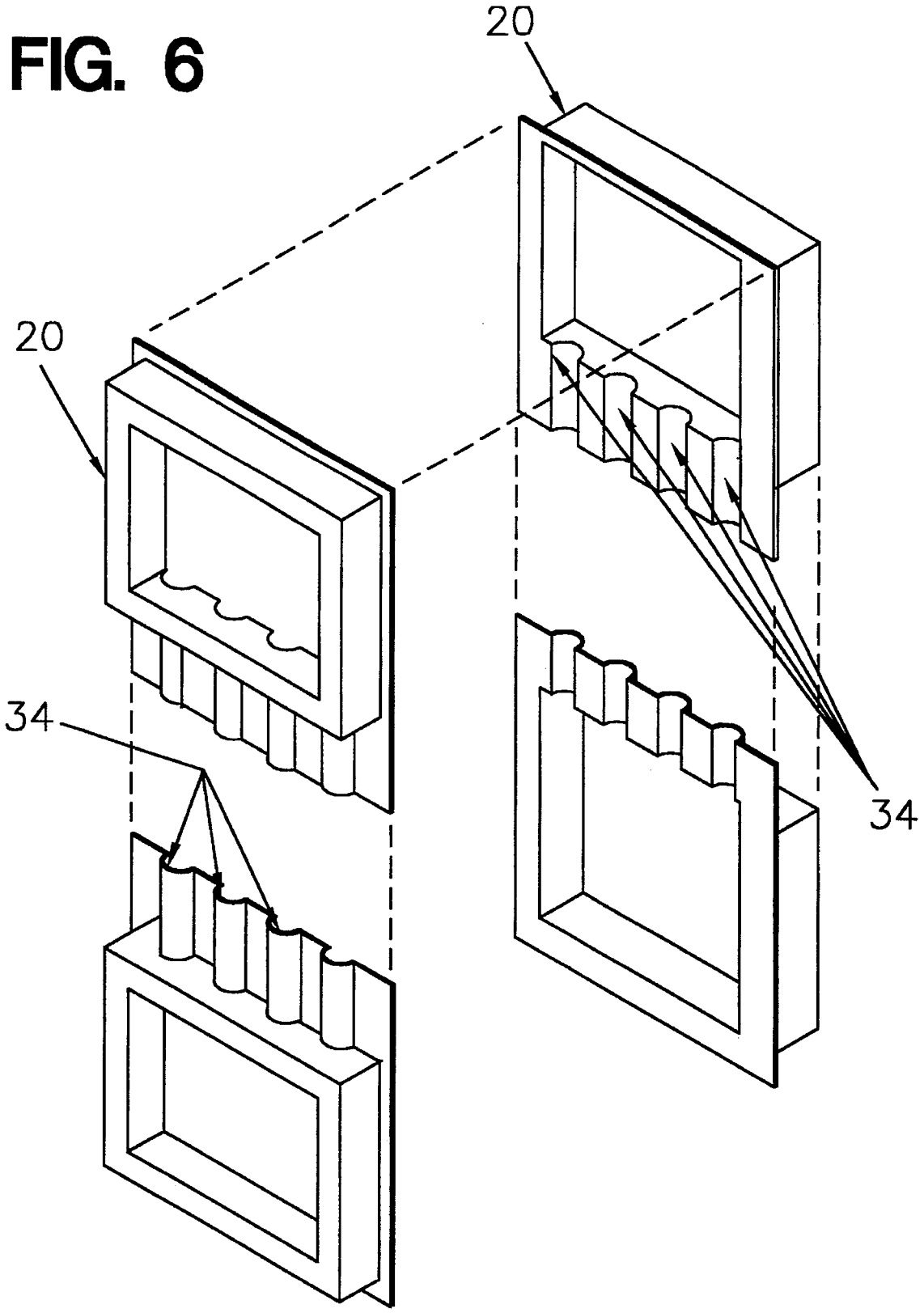
Figure 7:
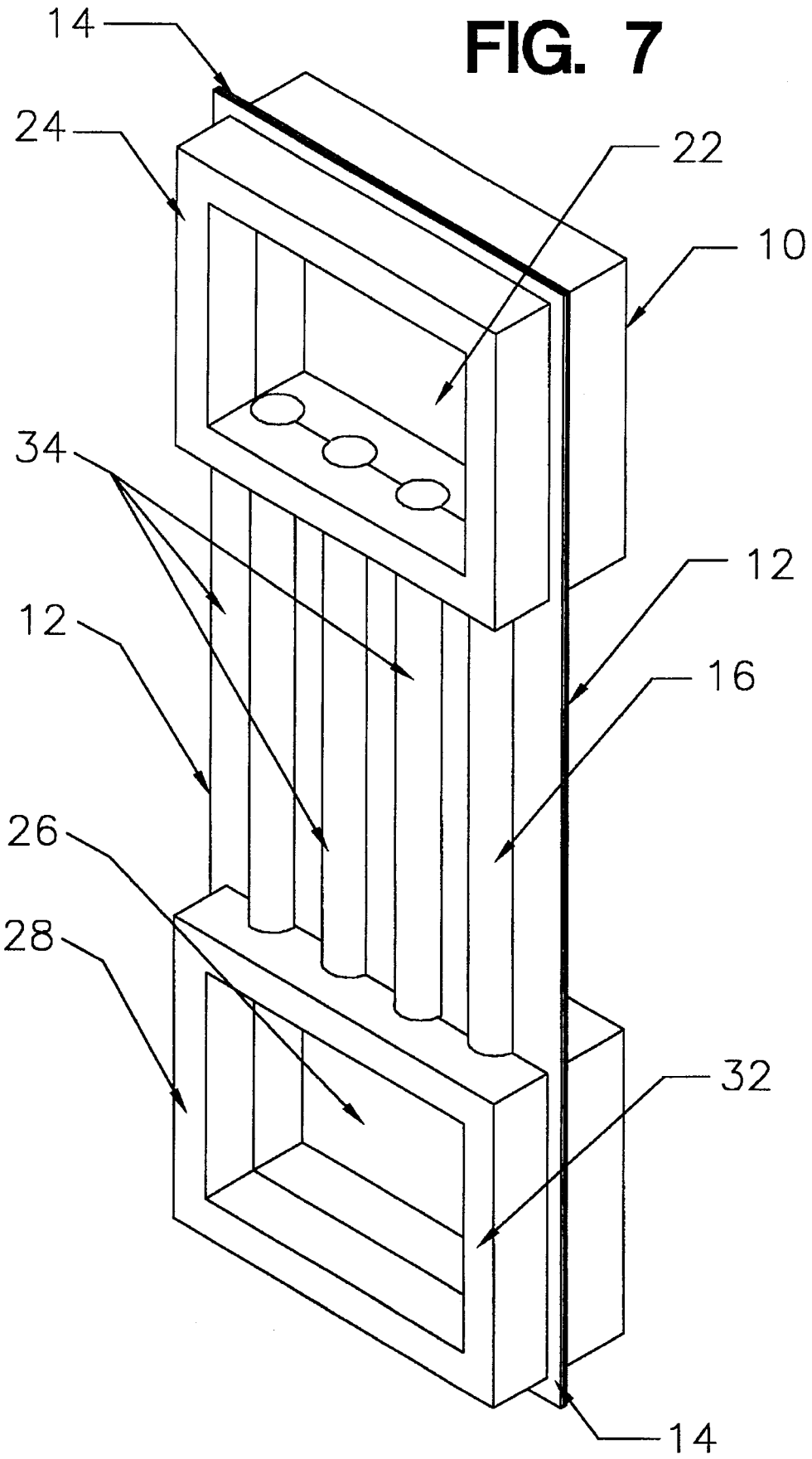
Figure 8:
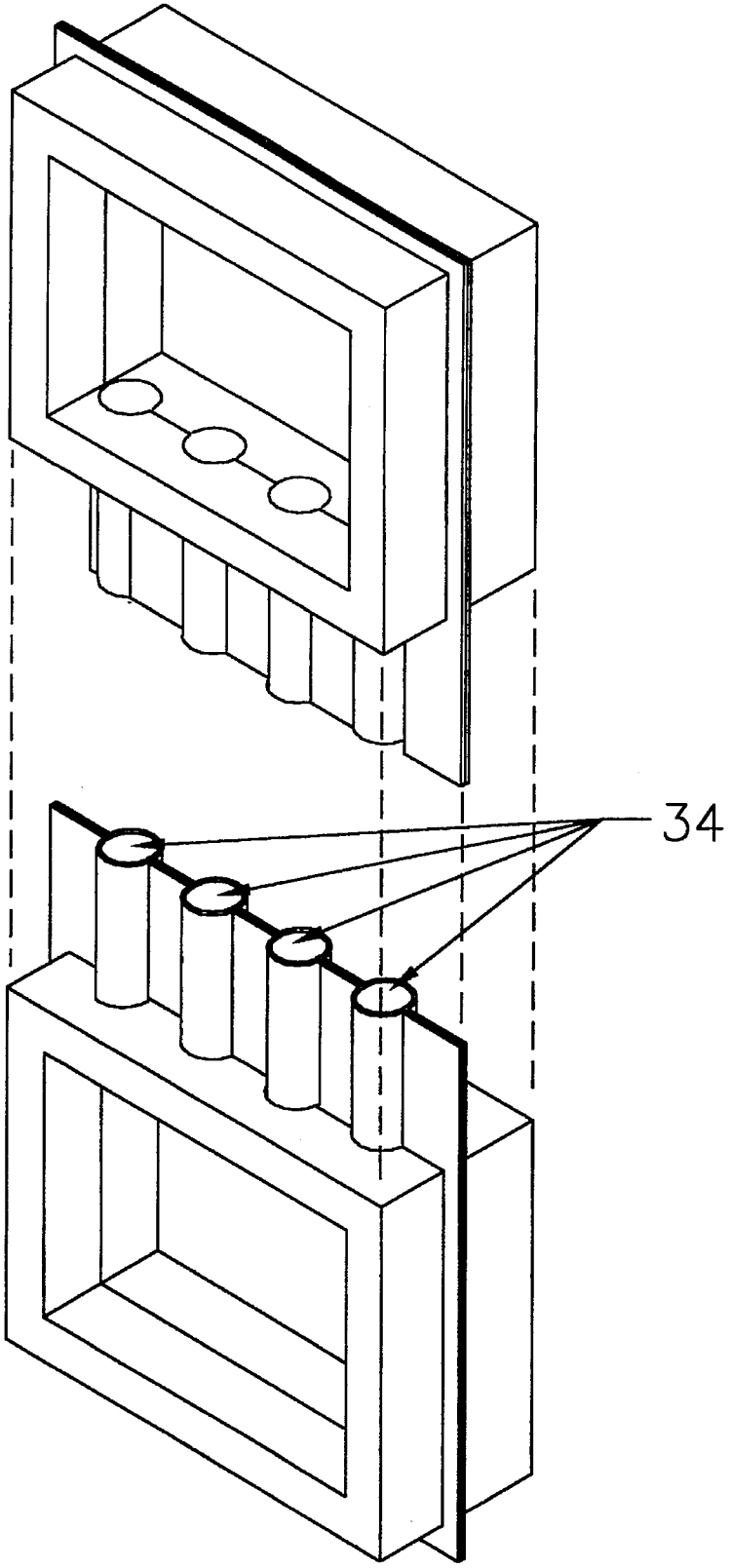

FIG. 1 is a conventional heat exchanger with a conventional coil of pipes conducting a first medium with thermally conductive fins in association therewith over which the second medium may pass. FIG. 2 illustrates a conventional heat exchangers with fan coils of the type shown in FIG. 1 which may be used for heating and/or cooling. FIG. 3 is an indirect evaporative cooling unit employing conventional heat exchangers. FIG. 4 is a cooling assembly with a desiccant wheel and conventional heat exchangers. FIG. 5 is a perspective illustration of a cooling unit with a desiccant wheel and conventional heat exchangers. These Figures are illustrative of assemblies wherein the heat exchangers of the present invention may be used as a substitute for known heat exchangers.

Shown in FIG. 4 for example, is an illustration of an air conditioning assembly. Such air conditioning assembly includes three parallel flow paths for air being conditioned. The central or first path is for the receipt of outside air, inside air or a combination thereof. It includes a blower to draw the air into the first path. It also includes a rotating desiccant wheel followed by a heat absorber last followed by a direct cooling pad. Thereafter fresh air from the first path is directed into the room or region to be conditioned.

One of the adjacent air paths, the second path, takes outside and/or inside exhaust air and draws it in through the use of a blower. Next following is an evaporator pad followed by a heat sink next followed by louvers for directing the exhaust back to atmosphere. Note is taken that a supplemental fluid line exists between the heat absorber of the first path, the heat sink of the second path and a pump within the second path adjacent to the blower.

The third path includes a blower for the receipt of outside air. This is next followed by a hot water supply heat regeneration followed by the desiccant wheel rotating about an axis parallel with and between the first and third air flow paths. Next following the desiccant wheel are louvers for exhausting the air to atmosphere.

In such an environment, as in the other environments as of the type illustrated in FIGS. 1 through 5, the conventional finned heat exchangers may be replaced by the heat exchangers of the present invention.

First or Molded Embodiment

More specifically and as shown in FIGS. 6 through 14, the new heat exchangers are in the nature of conduits for use in directing the flows of a primary fluid and a secondary fluid in heat exchanging relationship. By way of example, in the disclosed primary embodiment, the preferred primary fluid is water and the preferred secondary fluid is air to be conditioned.

The first component of the conduit is a vertically positionable elongated member 10. Such or member 10, or component of the assembly, has long parallel side edges 12 and short parallel end edges 14. It is of a generally rectangular configuration. It has generally parallel exterior faces 16 between the side and end edges.

In the preferred embodiment, each elongated component 10 is formed of two similarly shaped and configured facing parts 20. Such parts are of a similar or essentially identical construction. They are permanently coupled around their entire peripheries and at contacting areas therebetween to make a sealed container therein.

A header aperture 22 is formed to extend through the component from face to face adjacent to the first or upper end 24. Also in association therewith, a footer aperture 26, similar in size and shape to the header aperture 22, also extends through the member from face to face. The footer, however, is adjacent to the lower or the second end 28 of the elongated component.

The header aperture and the footer aperture have planar exterior peripheral surfaces 32 around their peripheries. Such planar surfaces are located at opposing ends of the apertures. They are at a first predetermined distance from each other. Such planar peripheral surfaces are attachable with planar peripheral surfaces of similarly shaped and configured elongated components. When coupled together, such plurality of components define an assembly with a first fluid path for the primary fluid beginning at the header, ending at the footer, and including the regions between the faces of the elongated members between the header aperture and footer apertures.

Coupling the headers and footers for each elongated component are a plurality of essentially parallel coupling linear extents 34. Such linear extents secure together the facing parts between the headers and footers of each elongated component to define flow paths for the primary fluid moving in the first flow path.

The facing components are secured together whereby the exterior surfaces of the linear extents 34 of the adjacent components are spaced a second predetermined distance. Such second predetermined distance is less than the first predetermined distance between the parallel faces at the header and footer.

The plurality of components 10 are secured together through end plates at their ends. Such end plates include upper end plates 38 and 42 as well as lower end plates 40 and 44 joined together at vertical recesses 48 and projections 50. One upper end plate 42 includes a header intake pipe 54 extending through one upper end plate 38 with an interior sealing plate 56 in contact with an endmost header aperture 22 for introducing a first heat exchanging fluid. A sealing plate 58 is at the remote end of the assembly to force the fluid downwardly through the linear extents 34 to the footer apertures 26. From the footer apertures, the first fluid moves to a footer outlet pipe 60 extending through one lower end plate 40 with an interior sealing plate 62 in contact with an endmost footer aperture 26. A sealing plate 64 is at the remote end of the assembly.

Coupling between the end plates is through a threaded pin 68 slidingly joining adjacent end plates. A washer 70 is secured to the pin and a coil spring 72 contacts the washer and one end plate to urge separation. Such separation thereby functions to hold the end plates separated and hence the headers and footers as well as the ends of the components of the assembly. Adjustment nut 73 may be adjusted for varying the tension. A similar arrangement is at each end of the assembly.

The last component of the individual elongated members are spacer members 82. The spacer members or spacers 82 are associated with the exterior surfaces of the facing components between the header aperture and footer aperture. Such spacers extend outwardly from the exterior surfaces to a distance essentially equal to the parallel exterior faces of the elongated components around the header aperture and footer aperture. In this manner, when a plurality of elongated members are coupled at their apertures, spaces will be formed between the exterior surfaces of the coupled elongated members. The spacer members hold such elongated members at a proper orientation to define, therebetween, a second flow path for the second fluid. Such second flow path is perpendicular to the first flow path for the first fluid. In this manner, when a first fluid of a first temperature is flowed in a first path while a second fluid from a second temperature is flowed in a second path, a heat exchange will occur between the two fluids therebetween.

Figure 12:
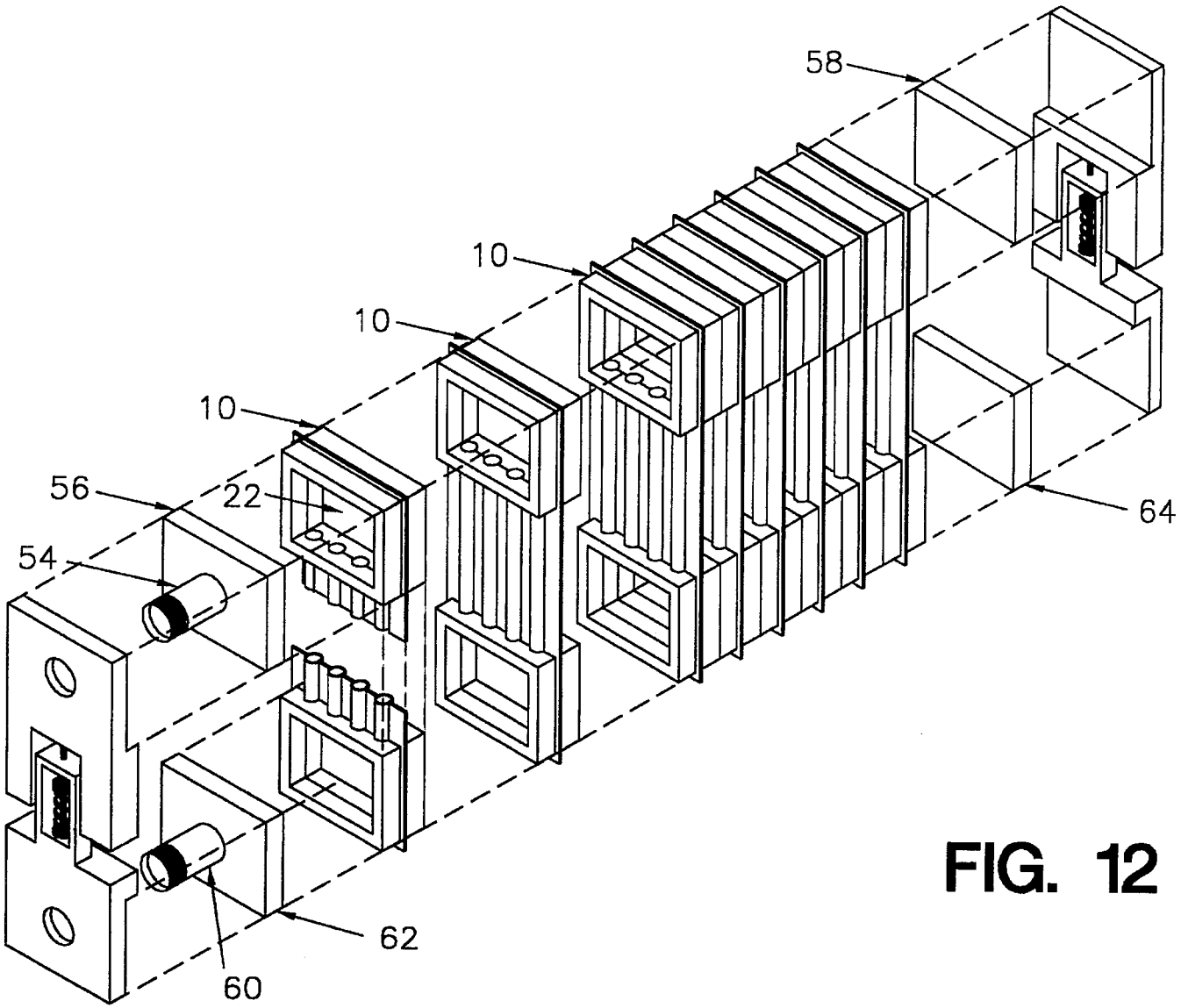
Figure 13:
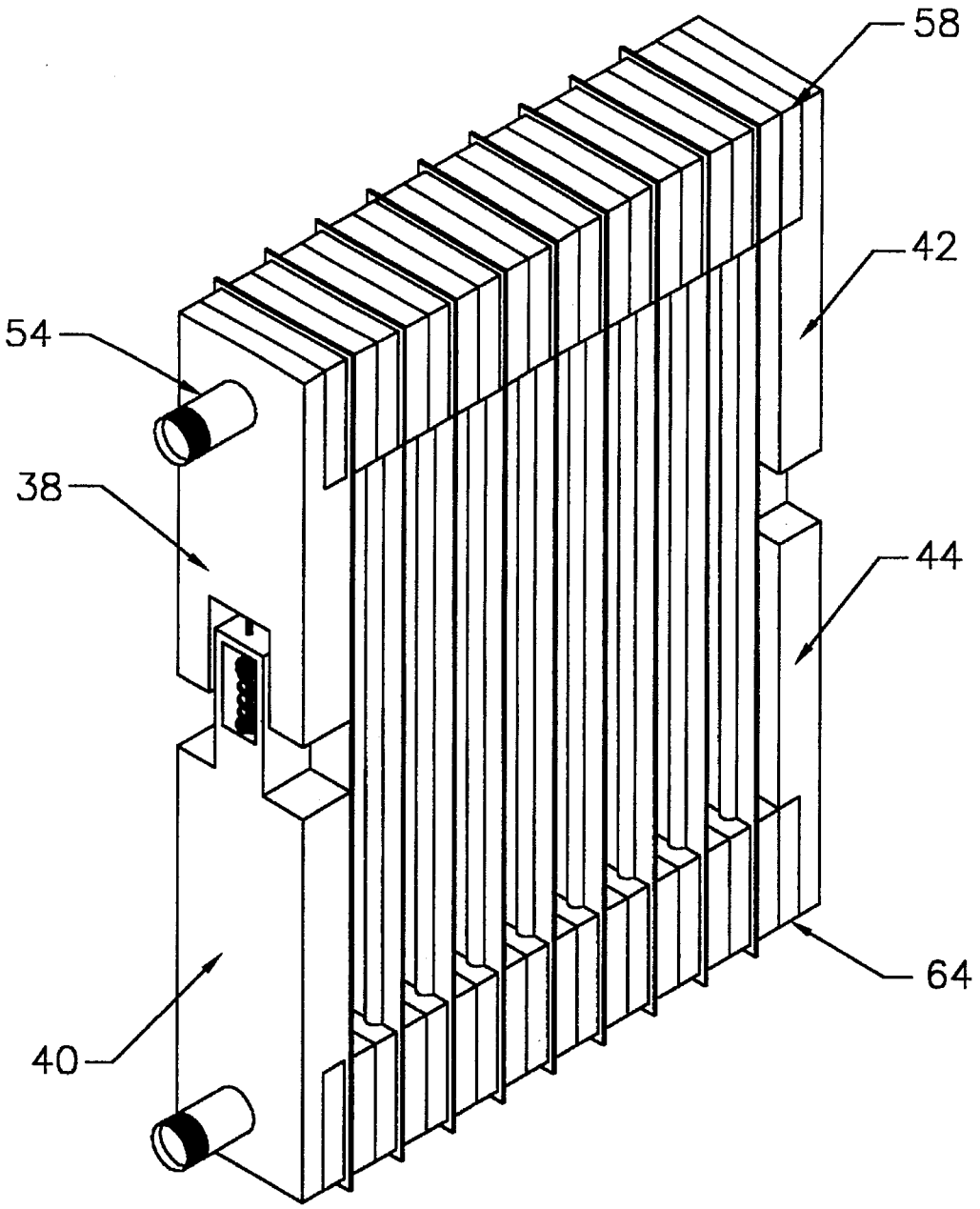
Figure 14:
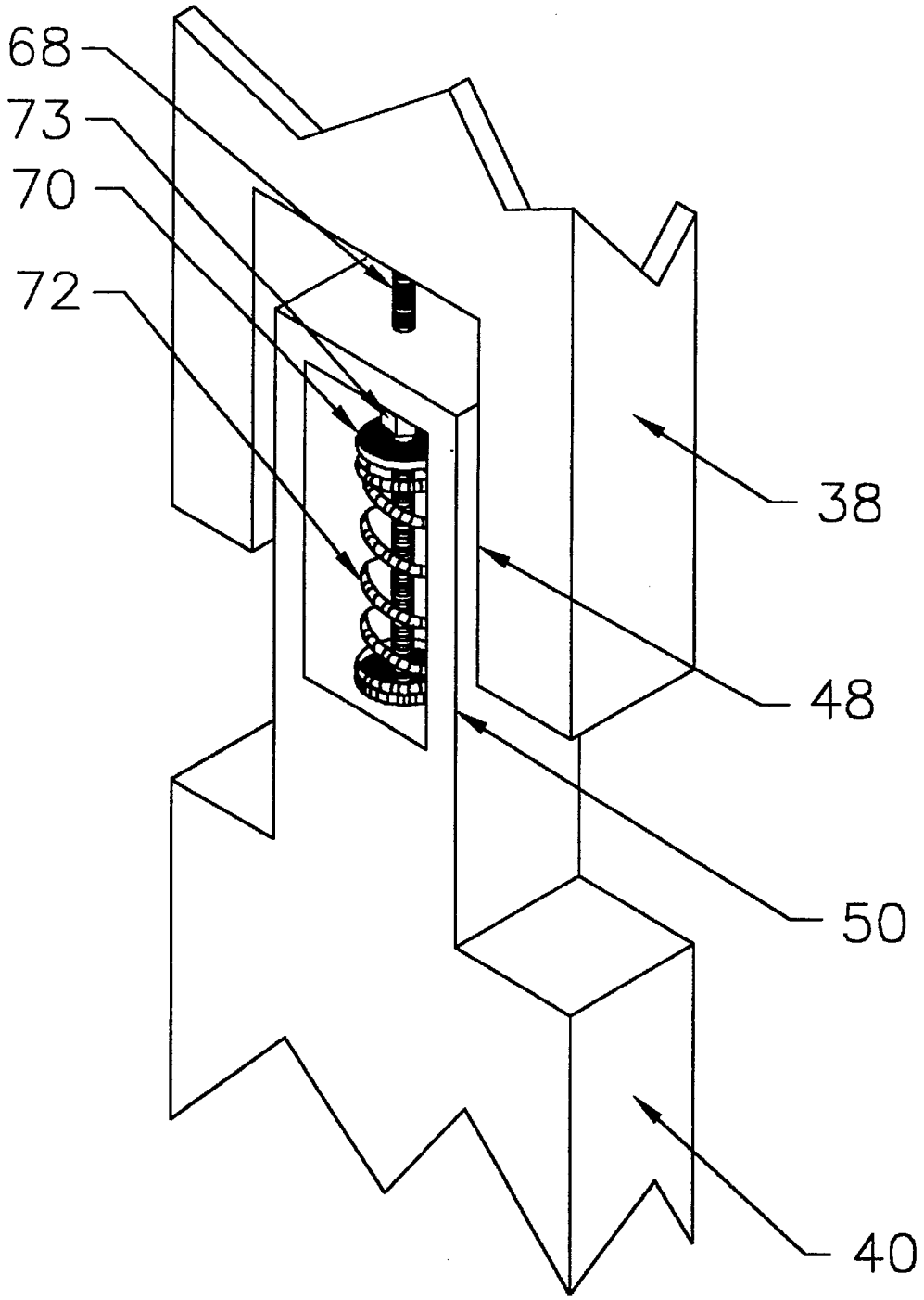
Figure 15:
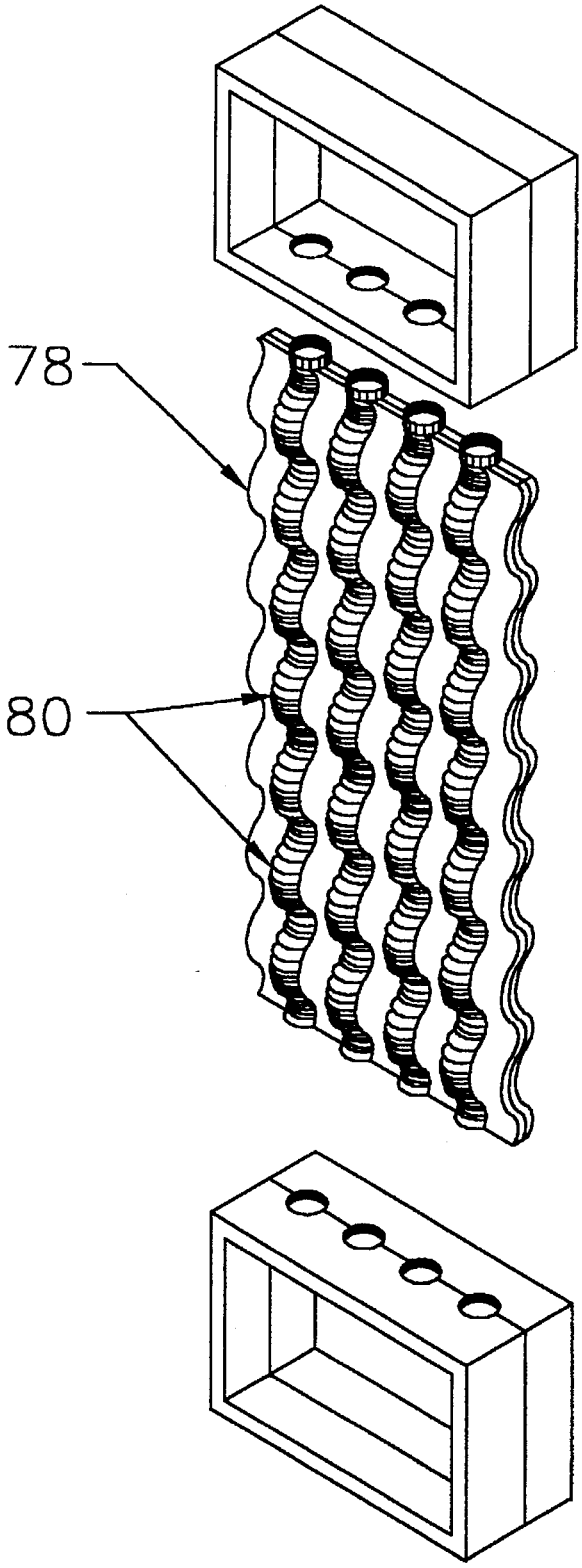
Figure 16:
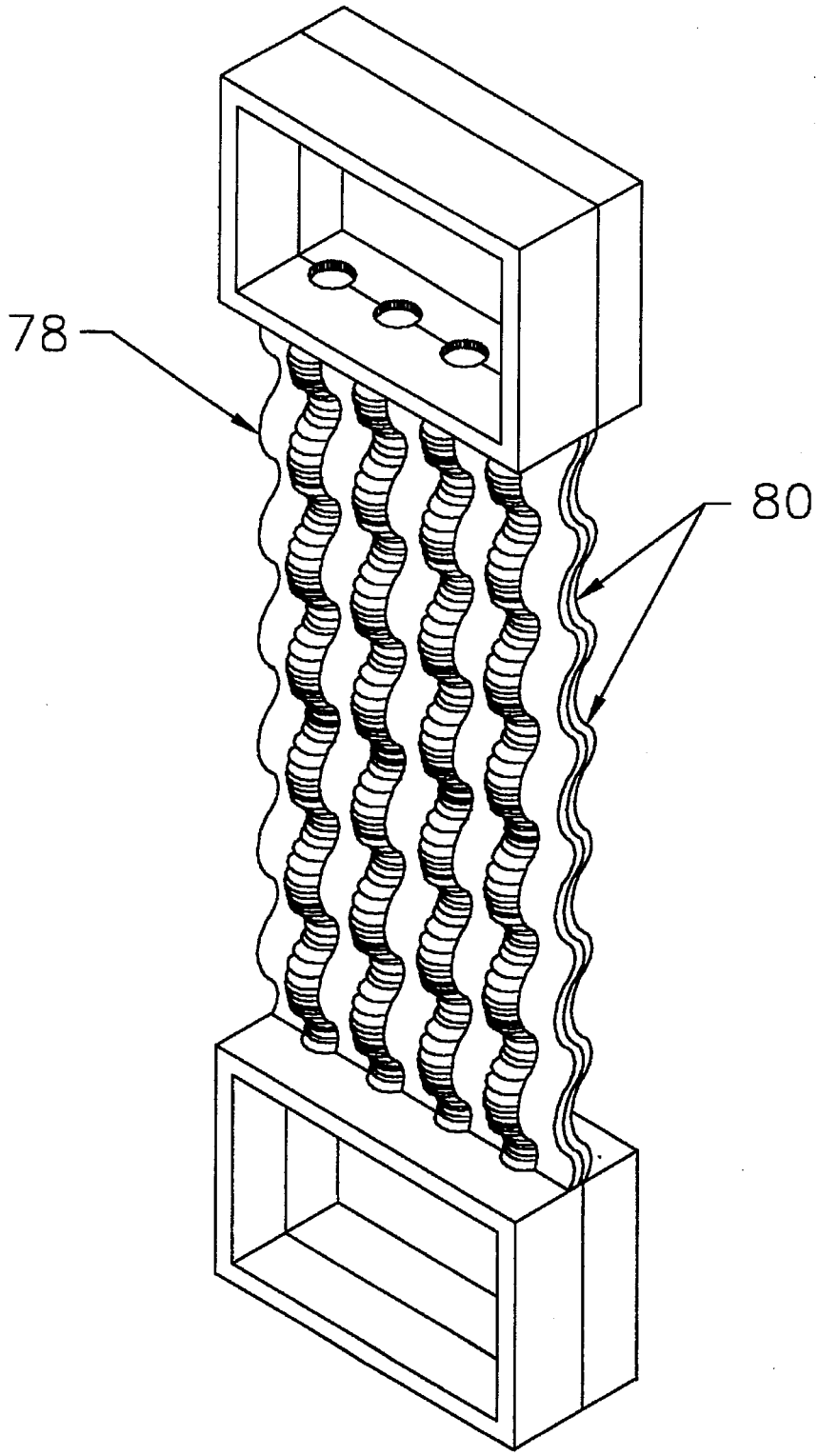
Figure 17:
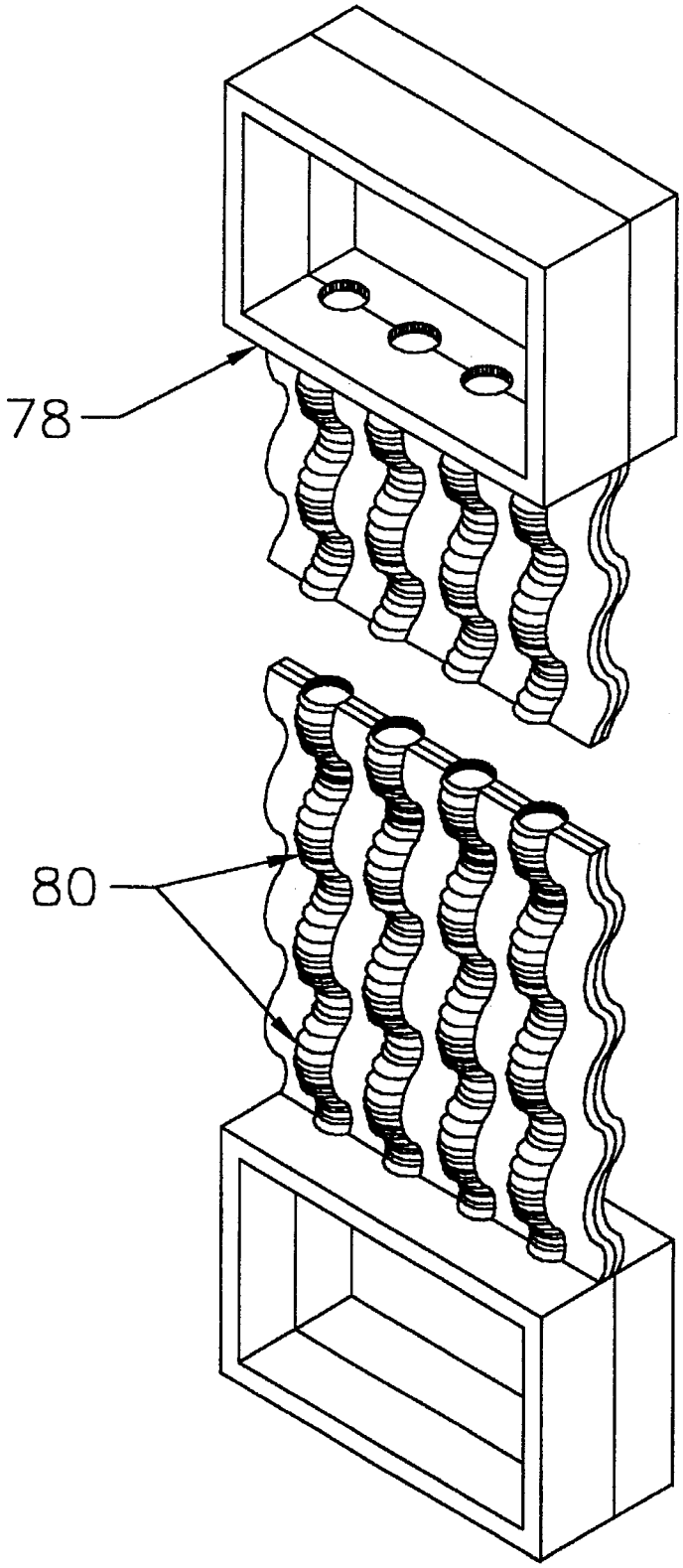
Figure 21:
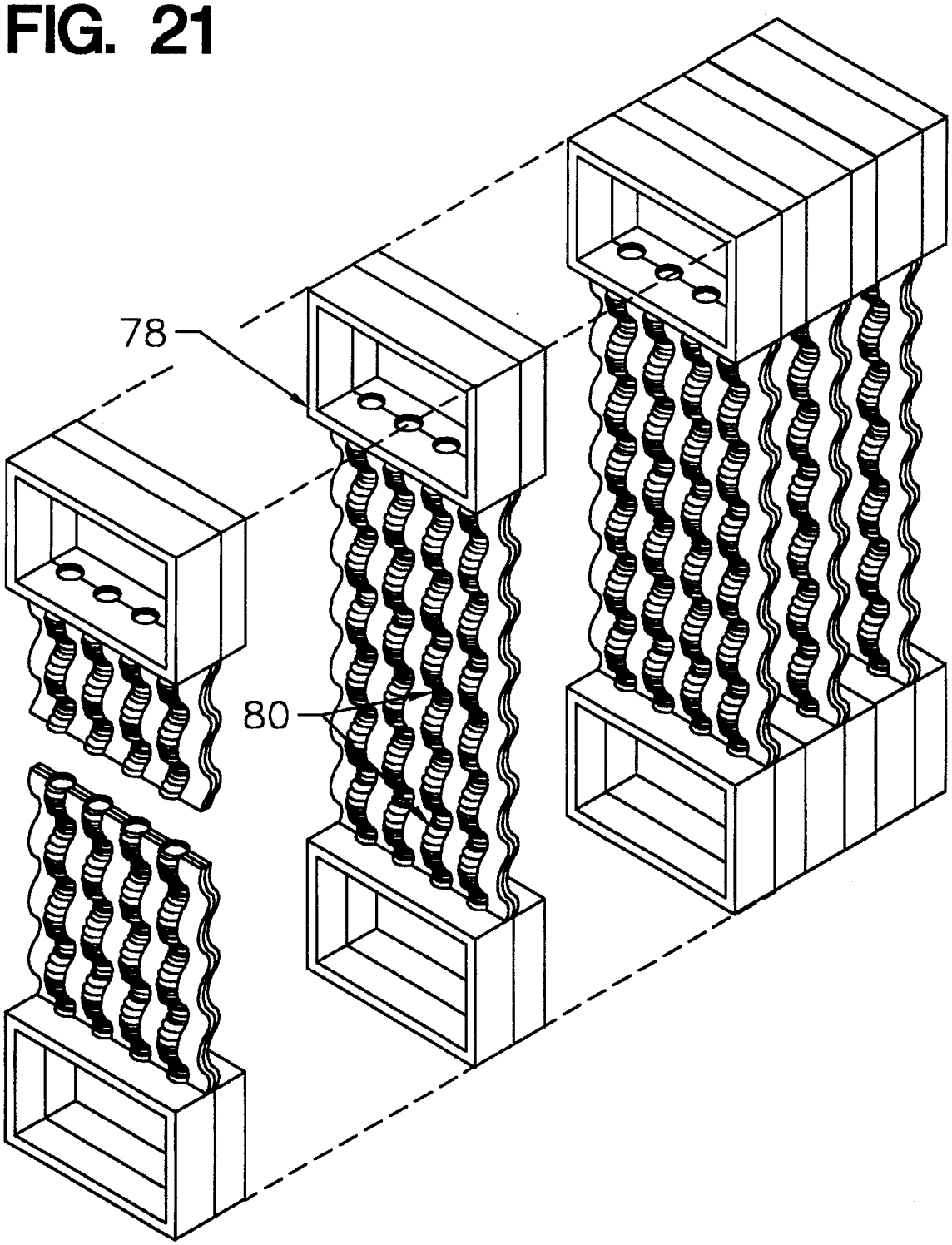
Figure 22:
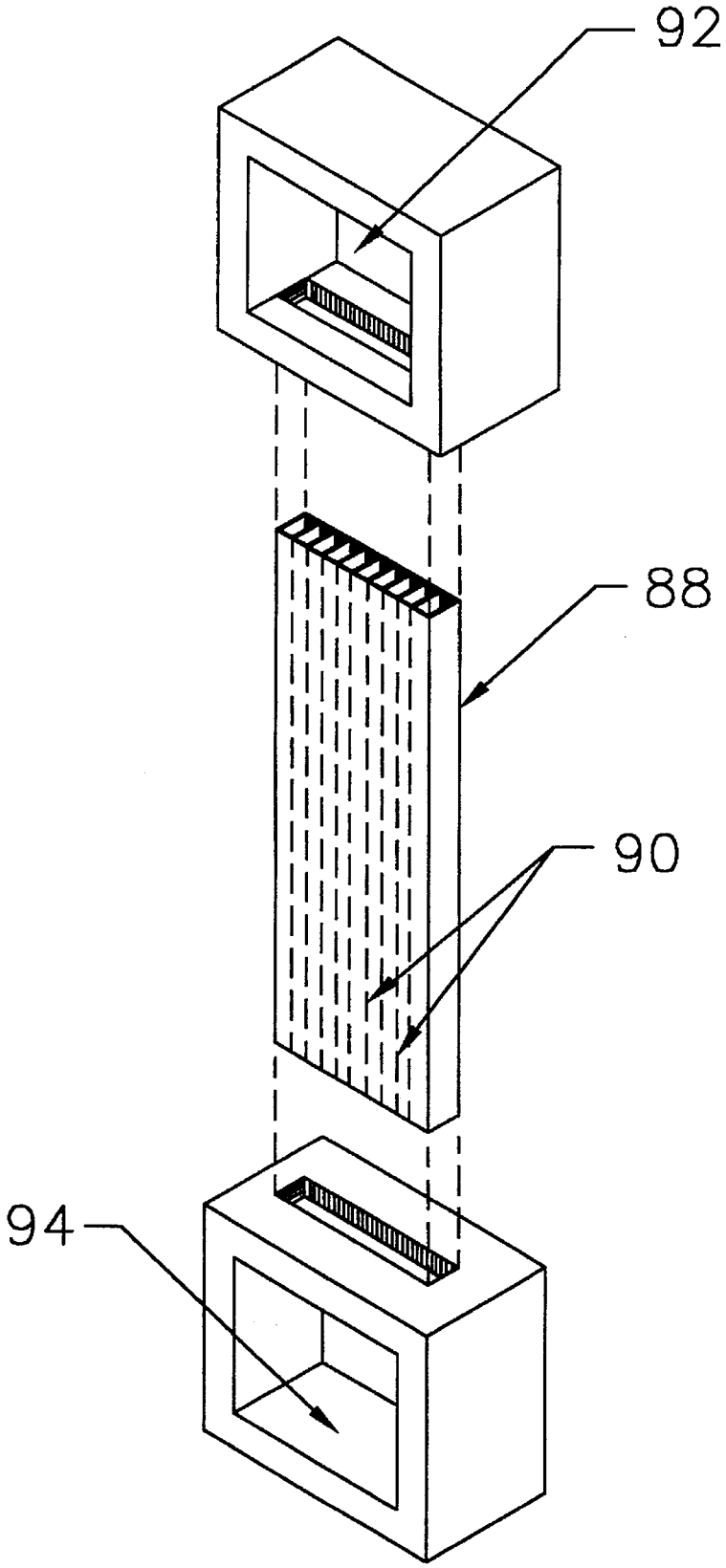
Figure 23:
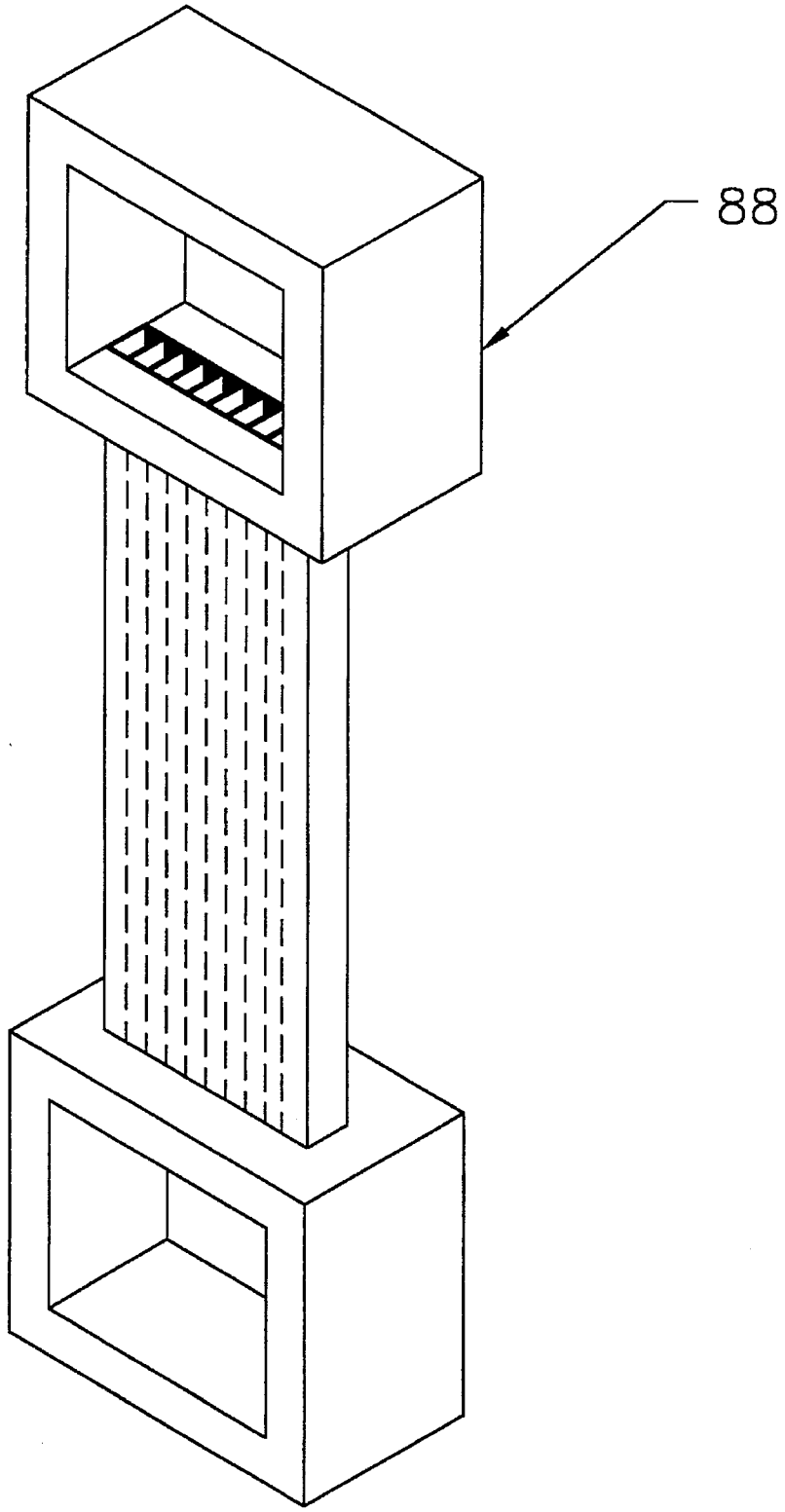
Figure 24:
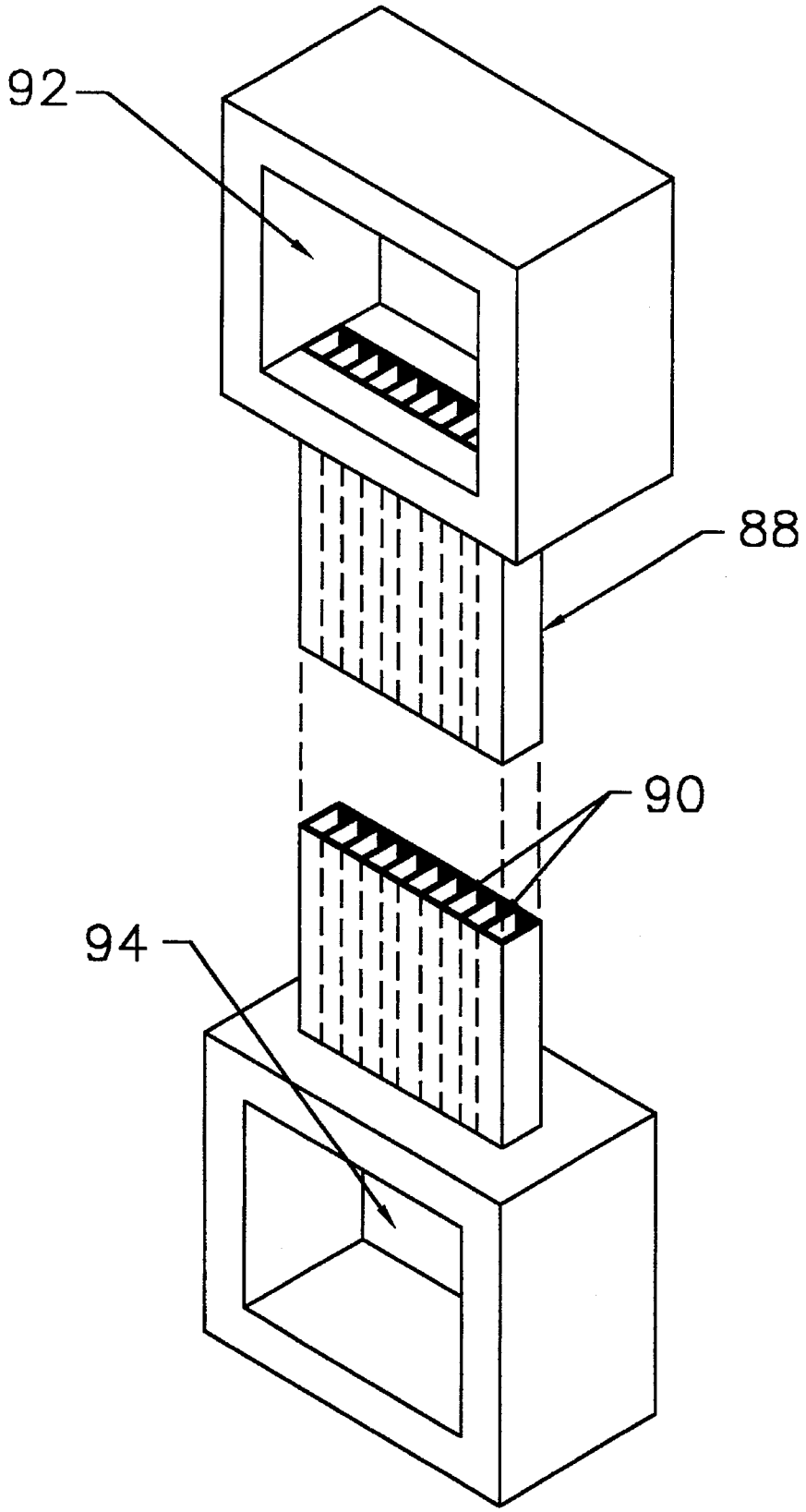
Figure 28:
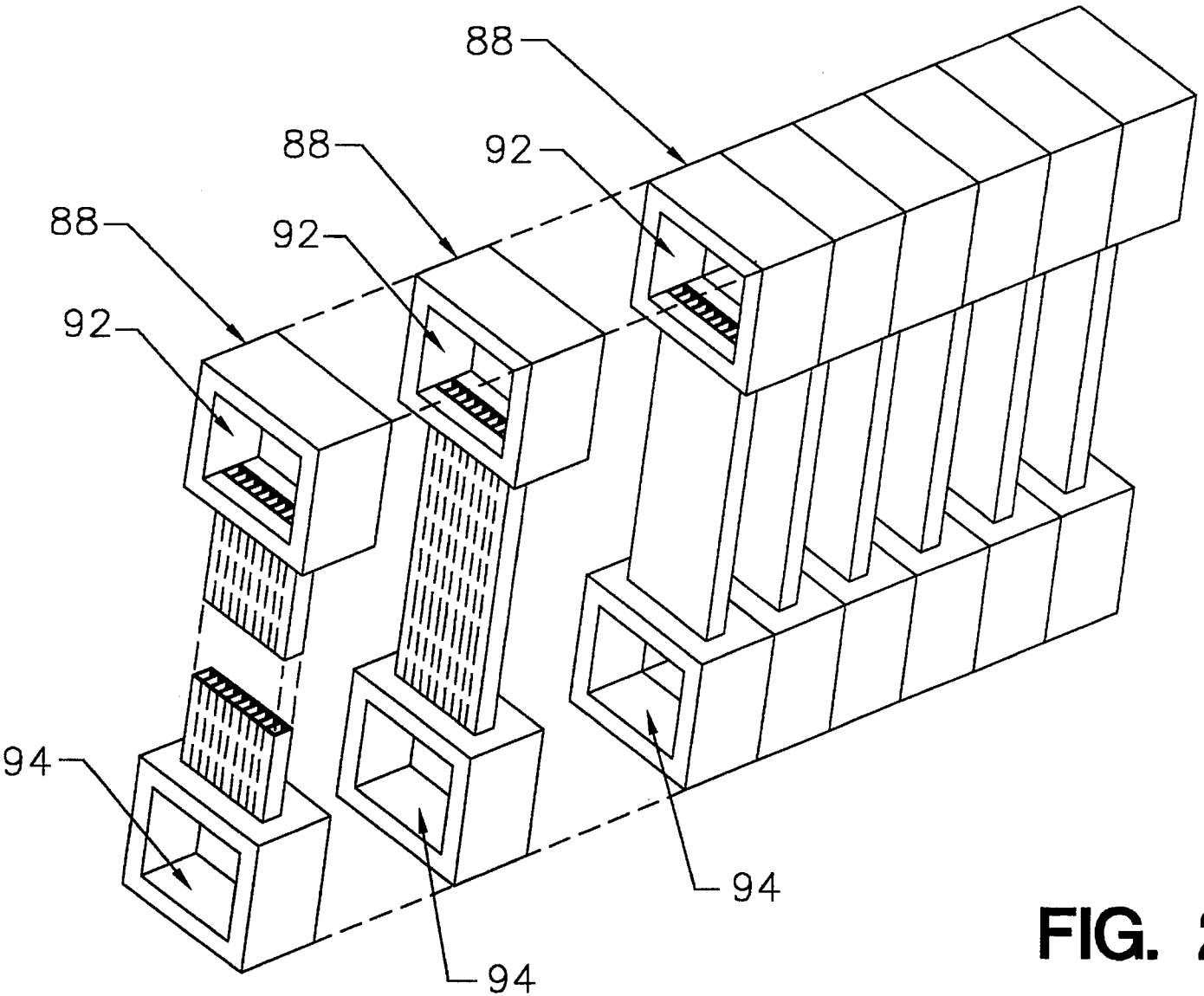

A variation of the first embodiment is shown in FIGS. 15, through 21. In such embodiment, the elongated members or components 78 are constructed essentially the same as in the embodiment of FIGS. 6 through 14. However, the materials forming the lines between the header and the footer are formed with undulations 80 along the length. The headers and footers are also provided with mechanisms tending to force apart the headers and the footers and hold them in proper spaced relationship. In this way, any expansion or contraction of the material between the header and footer, as caused by changes in temperature, will allow the headers and footers to remain in contact with their coupling components. The mechanisms for such purpose are essentially the same as shown in FIGS. 12 through 14 and described hereinabove.

Spacer numbers 83, similar to those of the prior embodiment are also employed. Such spacer members 83 are circular, preferably, while those of the prior embodiment are oval.

The members used to conduct the first fluid for transferring heat to the second unit may be made of any thermally conductive material, preferably a thermally conductive plastic material. The preferred plastic include polypropylene and/or polyethylene copolymers, either alone of in combination. A more preferred material is a polyamide, most preferably nylon. It should be understood, however, that any other thermal conductive materials could be utilized such as metals including copper, aluminum, steel or the like. Such material selections are applicable to the primary embodiment as described above as well as the alternate embodiments as described hereinafter.

Further, the heat exchangers could be used in gas to gas applications, most notable air to air. They could also be used in liquid to liquid applications. Further, they could be used in any liquid to gas as, for example, air in either direction, i.e., gas such as air to liquid. The selection of the fluids employed would be a choice for the application made.

Second or Extruded Embodiment

The second embodiment is shown in FIGS. 22 through 28. In such embodiment, the individual members 88 are formed as unitary devices and not of front and rear parts. In addition, the lines 90 between the header 92 and footer 94 are formed as extruded plastic members such as tubes, fins, flutes, etc. In such embodiment, the lines simply couple the headers and the footers and function in a manner essentially the same as in the primary embodiments.

Figures 29, 30:
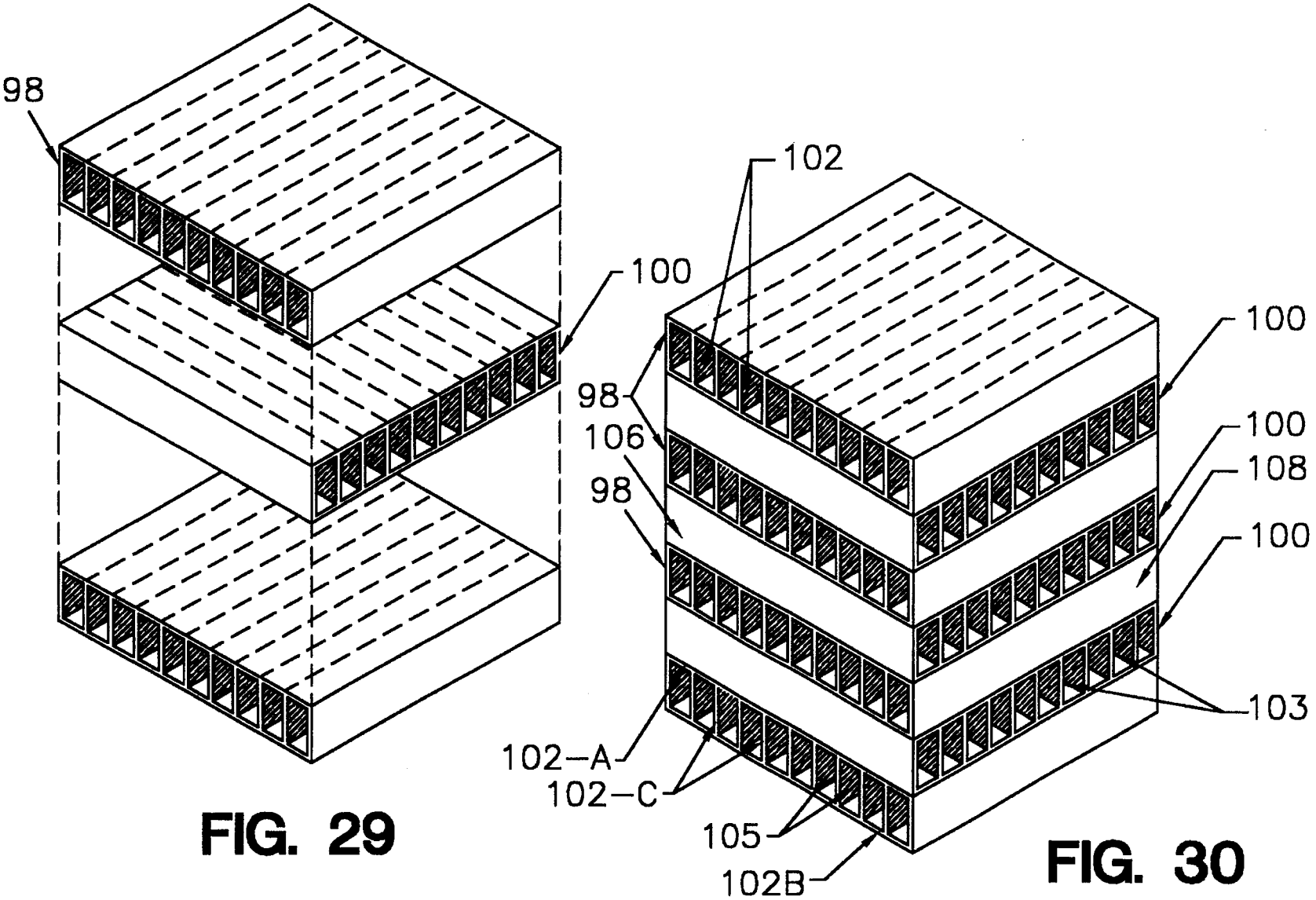
FIGS. 29 through 32 illustrate a variation in the extruded embodiment of FIGS. 22 through 28, FIG. 29 being an exploded perspective view of extruded components, FIG. 30 being a full block of extruded components in an assembled orientation, FIG. 31 being an perspective showing of an extruded block configuration with coupling components, FIG. 32 being a fully assembled block with assembled components.

A variation of this embodiment is shown in FIGS. 29 through 32. In such variation, a plurality of extruded components 98 and 100 with parallel linear lines 102 are stacked one above the other. In such stacking, the axis of the passage ways or lines 102 for the flow of fluid in the adjacent components are at right angles to each other alternately. Thus, as can be seen in FIG. 30, fluid input for the first path begins upon a surface 106 with spaced parallel rows of fluid lines. The input couplings for the second fluid for the second path of travel is from input surface 108 at right angles with respect to the first input surface 106. As such, the natures of the headers and footers are significantly different than in all of the prior embodiments. Hardware in the nature of corner brackets 112 and end plates 114 couple to provide regions for coupling with associated ducts.

More specifically, the invention of the extruded embodiment relates to a conduit assembly for use in directing the flows of a primary fluid and a secondary fluid in heat exchanging relationship. Such assembly includes a first fluid impervious planar member 102A and a second fluid impervious planar member 102B. The planar members are of a similar construction and in spaced parallel relationship with each other. Such assembly also includes a plurality of coupling members 102C in spaced relationship one to an other and coupled at their first ends to the interior face of the first planar member and coupled at their second ends to the interior face of the second planar member. The coupling members are laterally spaced with respect to each other to define therebetween a plurality of linear first fluid paths 103 from one end of the planar members to the other end of the planar members through a plurality of similar shaped channels peripherally bounded by the planar members and adjacent coupling members. Such assembly also includes coupling means 38, 40 and 115 to join together a plurality of conduits with alternating conduits having their channels in a common first direction defining the first path and with the remaining conduits having their channels in a common second direction perpendicular to the first path. First attachment means are provided for the coupled conduits at first opposite sides of the coupled conduits for the flow of a first fluid in a first fluid path, and second attachment means are also provided for the coupled conduits at second opposite sides of the coupled components for the flow of a second fluid in a second path 105. Consequently, when a primary fluid, preferably water, is fed through the first path at a first temperature and a second flow of fluid, preferably air, is fed through the second path at a second temperature, a heat transfer occurs therebetween.

A yet further variation of the second embodiment is shown in FIGS. 33 through 37. In such embodiment, the extruded components 98 with lines 102 are placed in parallel paths for the first flow of fluid travel. Thereafter, between such plates, spacers 115 are positioned. Such spacers are simply rectangular tubes extending to the edges of the spaced components of the first embodiment. As such, the path of flow of fluid in the second path as seen in full view of FIG. 36 allows for a smooth flow of travel of the second fluid in the second path of travel.

Third or Undulating Embodiment

The third embodiment is shown in FIGS. 38 through 42. In such third embodiment, a stack of sheets 116 and 118 with lines 120 is provided in a manner analogous to the embodiment of FIGS. 29 through 32. In such embodiment, however, the stacked materials are sheets of a fluid impervious material which are corrugated, fluted, etc. Such sheets include a planar sheet 124 with an undulating sheet 126 coupled thereto at spaced lines 128. Between the spaced lines there are provided channels or lines 120 in a curved configuration for the passage of fluid from one of the fluid paths or the other. The undulating sheets are then placed at right angles to each other to define an input and output end in a first linear path and to define a second linear path perpendicular to the first path for feeding the second fluid in heat exchanging relationship with the first fluid of the first path moving at right angles with respect thereto.

Figure 31:
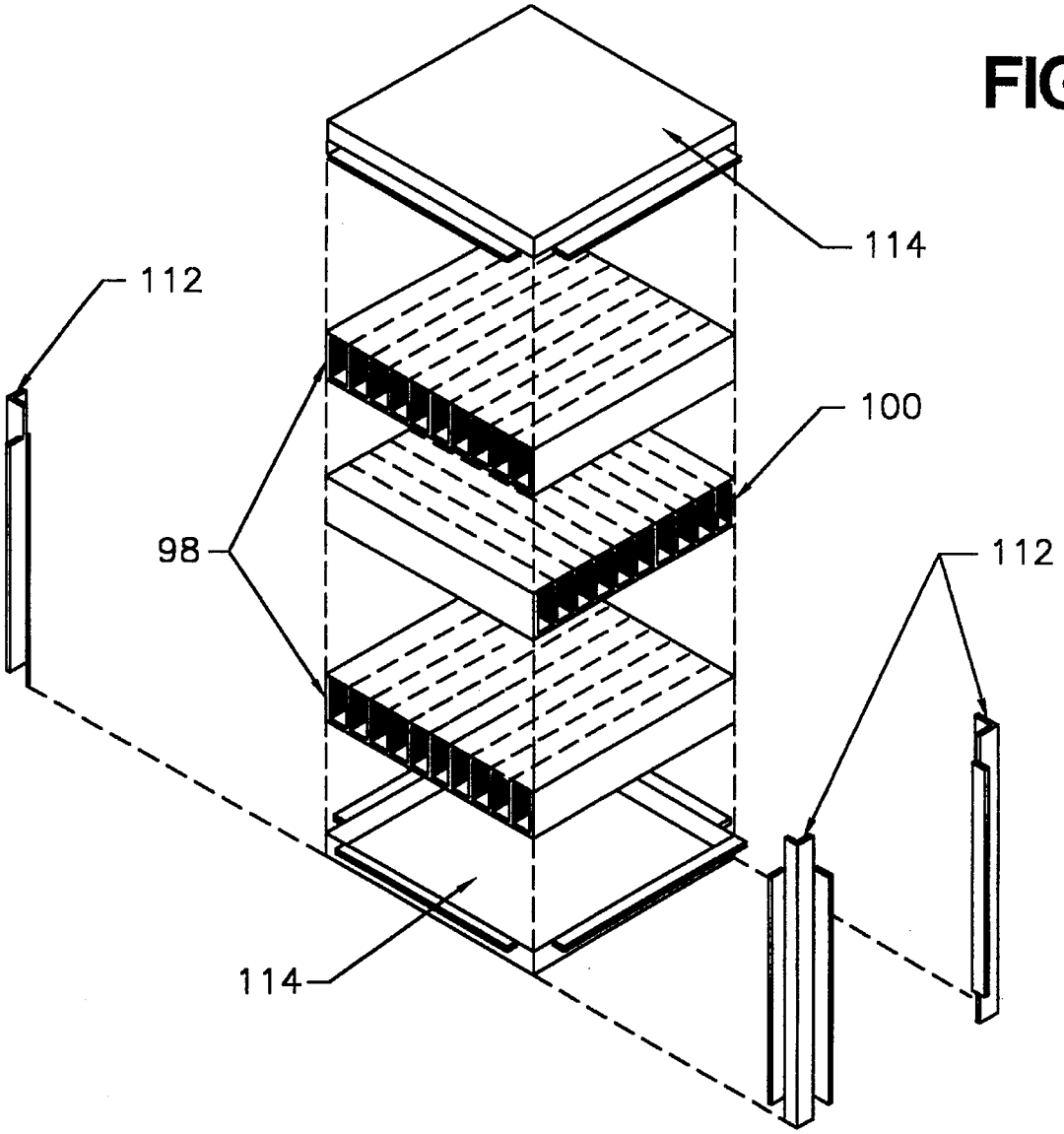
Figure 32:
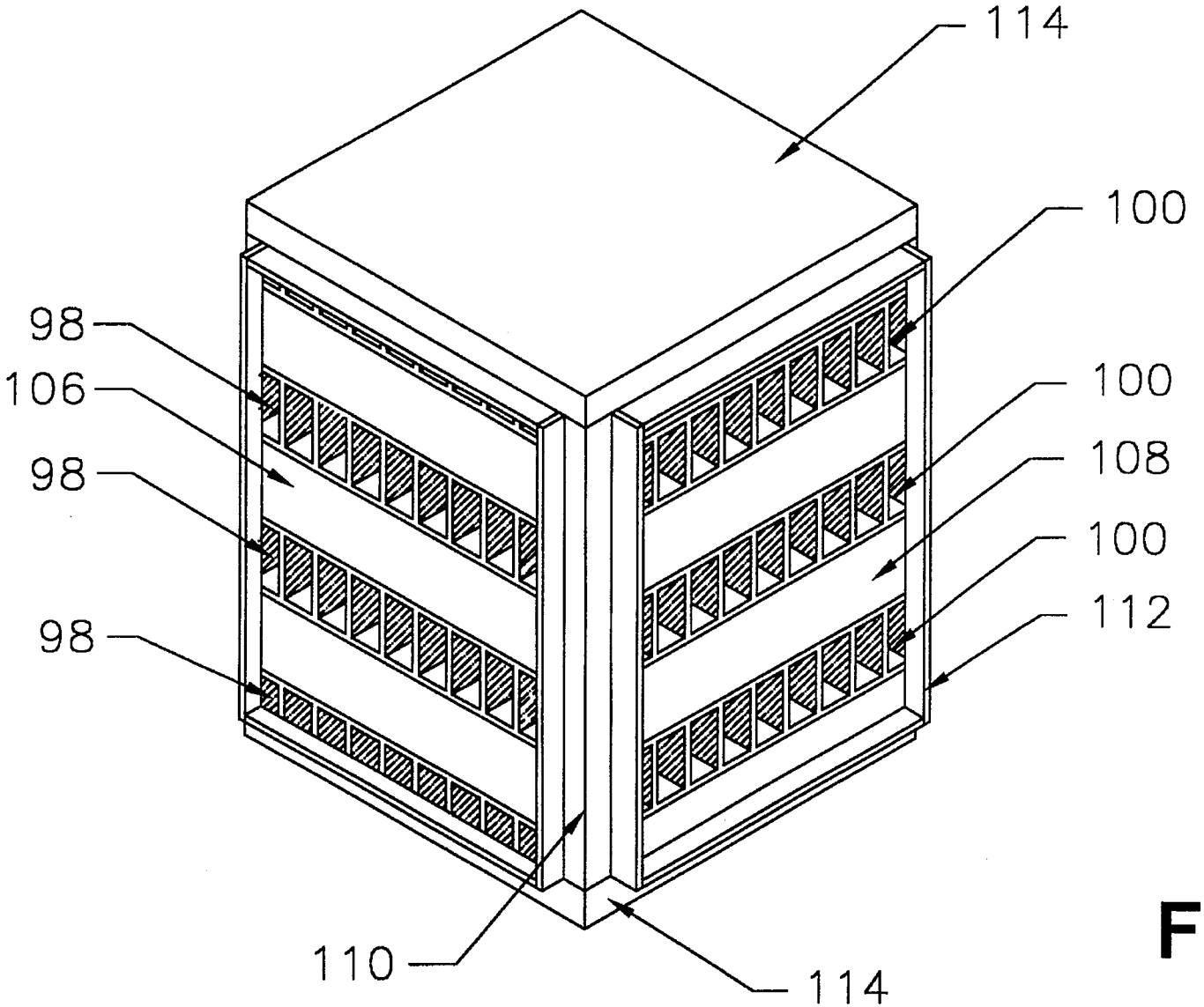
Figure 34:
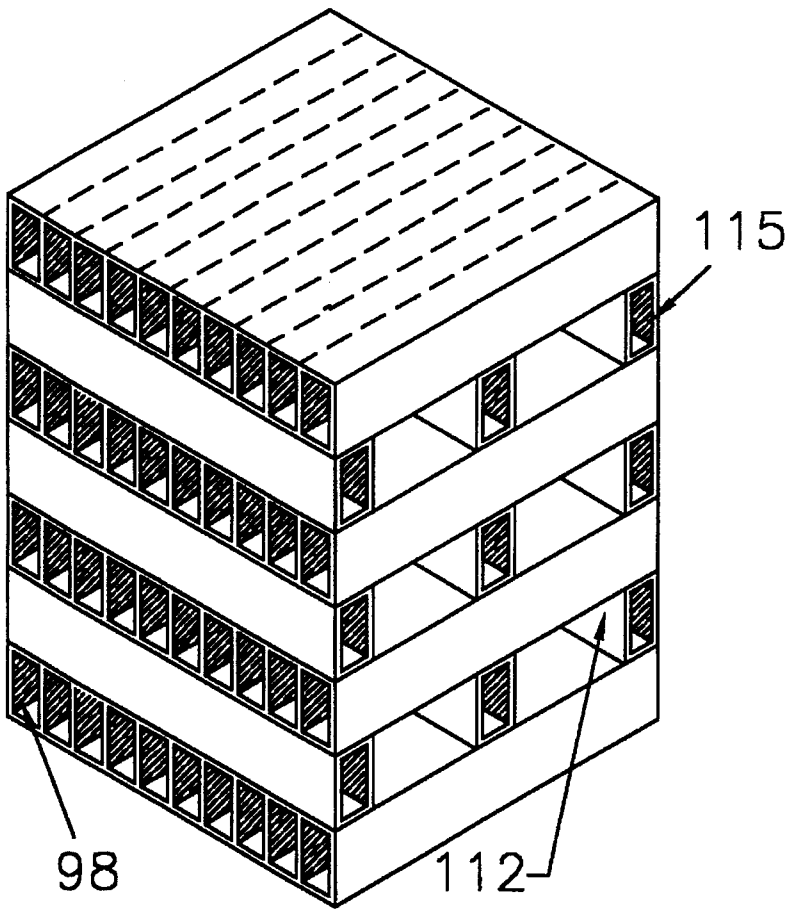
FIG. 33 through 36 are illustrations of an other variation of the extruded embodiment, with spacers being located between fluid transferring components, FIG. 33 being an exploded view of two components with spacers therebetween, FIG. 34 being a full block of components and spacers in an assembled orientation, FIGS. 35, 36 and 37 being a front elevation, side elevation, and top elevational view of the components shown in FIGS. 33 and 34.
Figure 33:
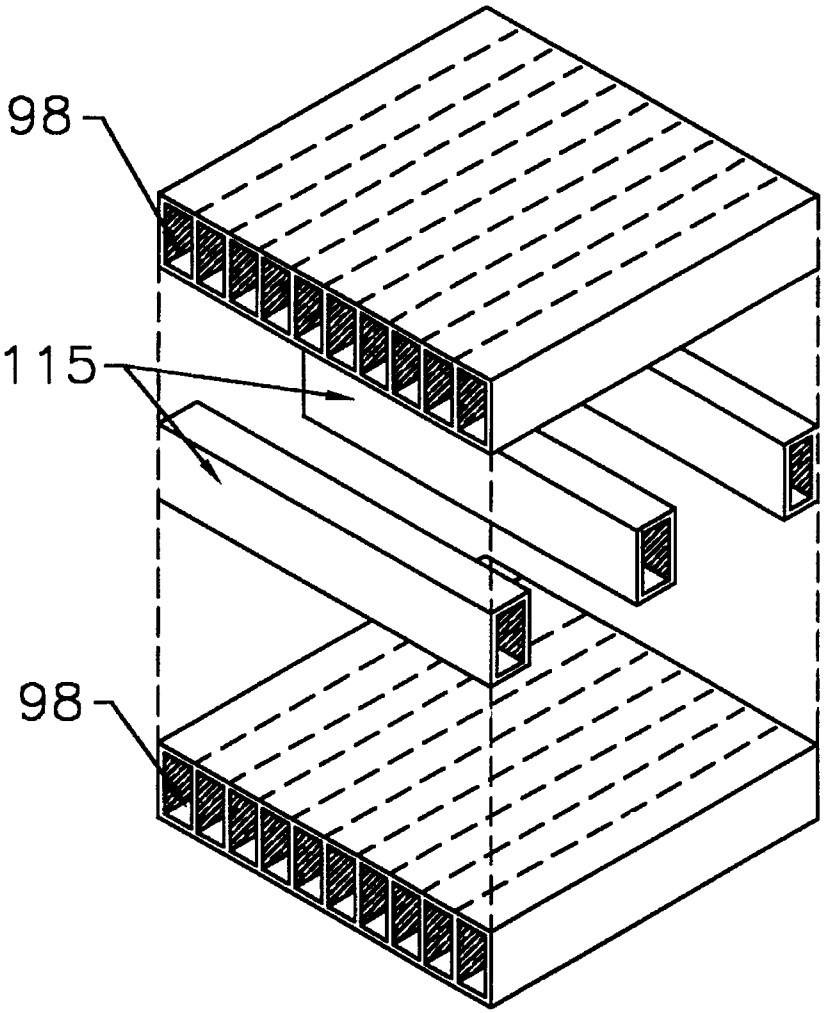
Figure 37:
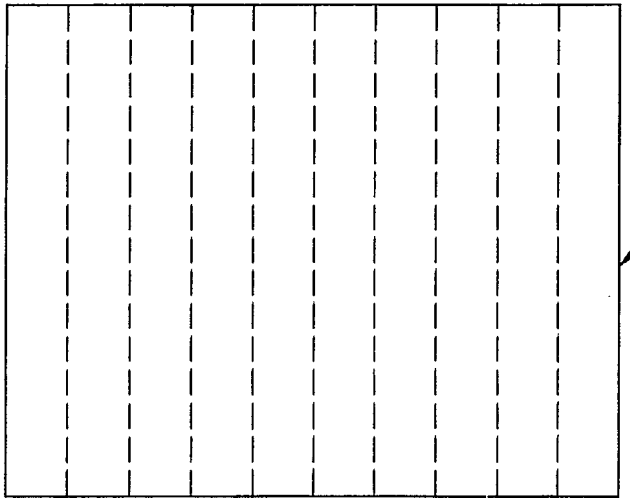
FIGS. 37 through 41 are illustrations of the third embodiment of the invention, the corrugated embodiment, FIG. 37 being an exploded view of two components with spacers therebetween, FIG. 38 being a full block of components and spacers in an assembled orientation, FIGS. 39, 40 and 41 being a front elevation, side elevation, and top elevational view of the components shown in FIGS. 37 and 38.
Figure 35:
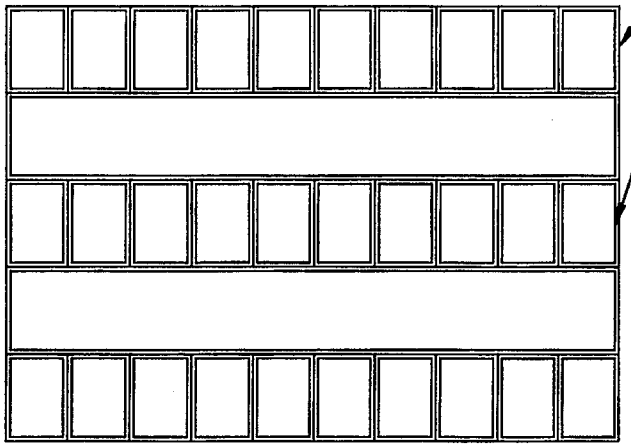
Figure 36:
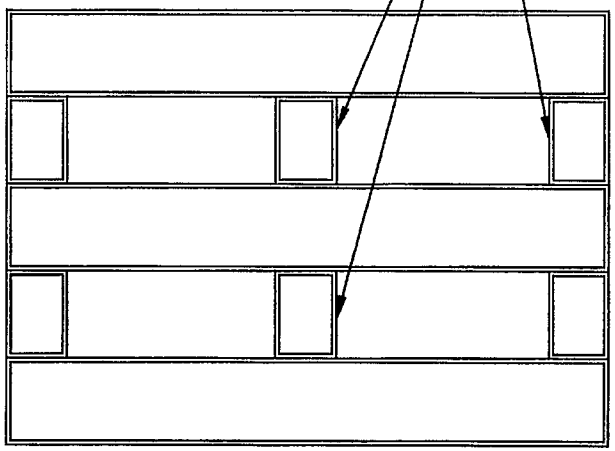
Figure 39:
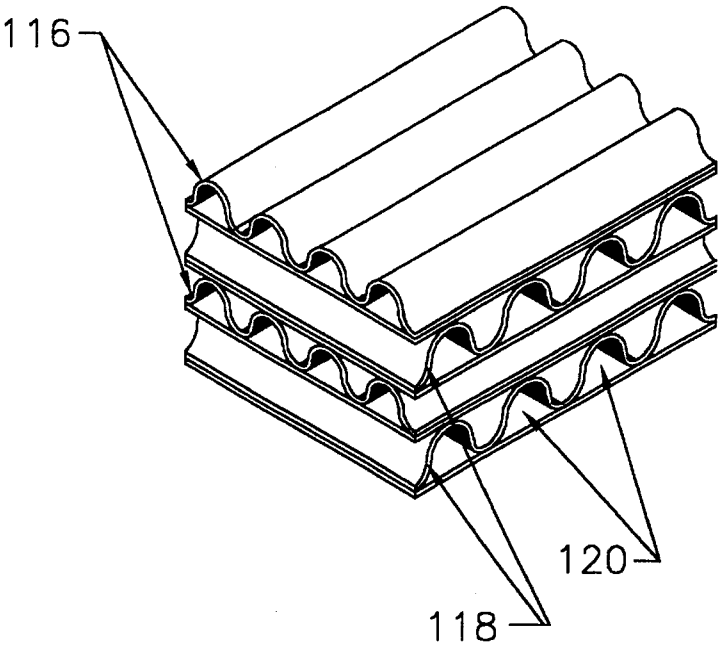
Figure 38:
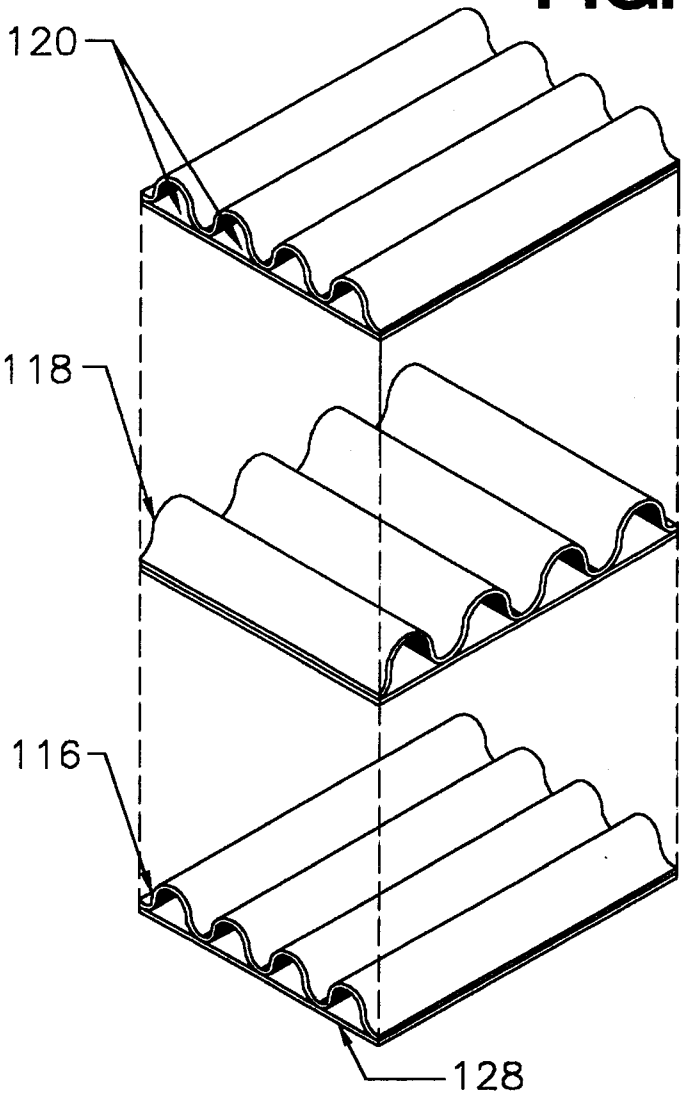
Figures 40, 41, 42:
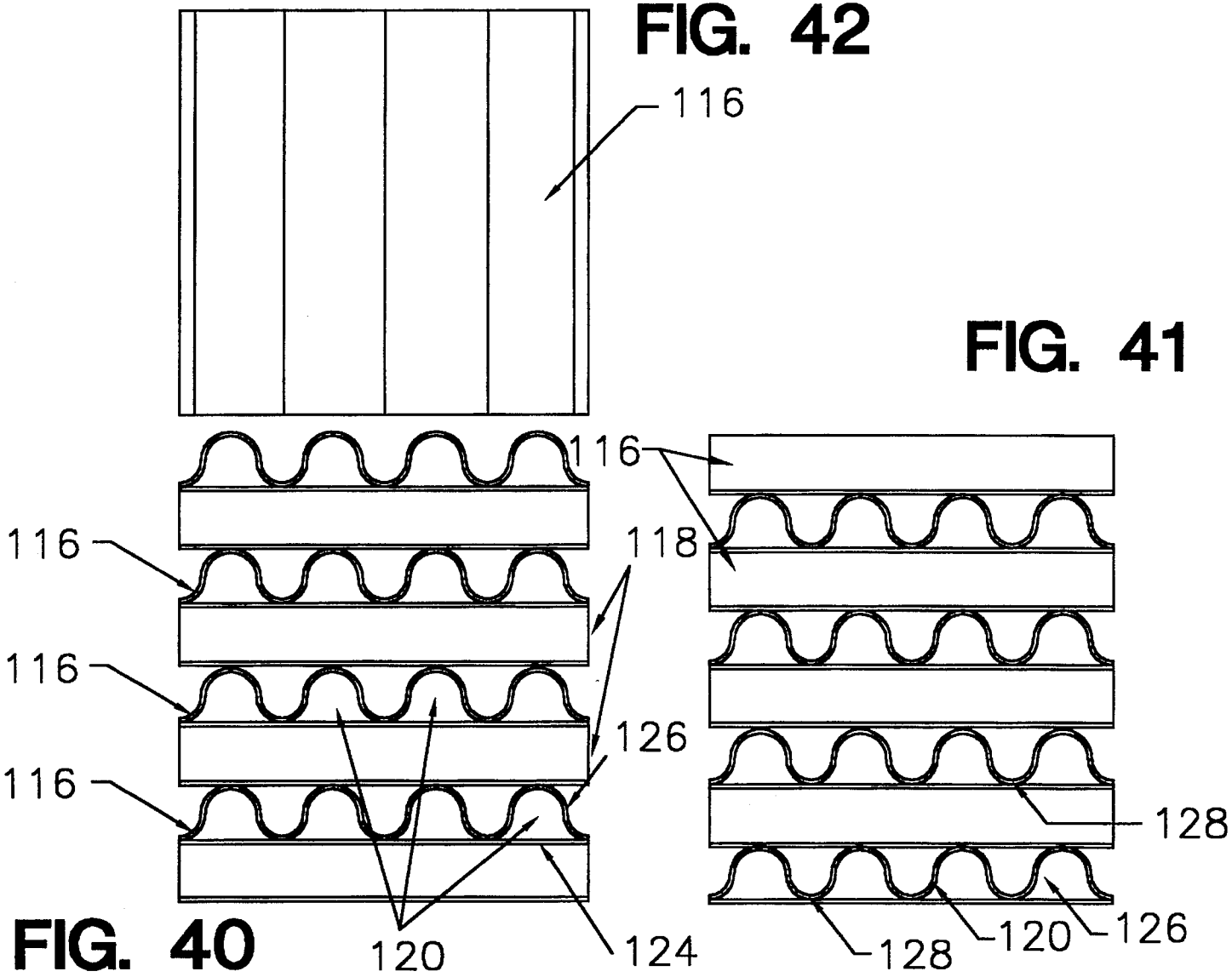
FIGS. 42 through 46 are illustrations of a variation of the corrugated embodiment of FIGS. 37 through 41, FIG. 42 being an exploded view of two components with spacers therebetween, FIG. 43 being a full block of components and spacers in an assembled orientation, FIGS. 44, 45, 46 and 47 being a front elevation, side elevation, and top elevational view of the components shown in FIGS. 43 and 44.
Figure 43:
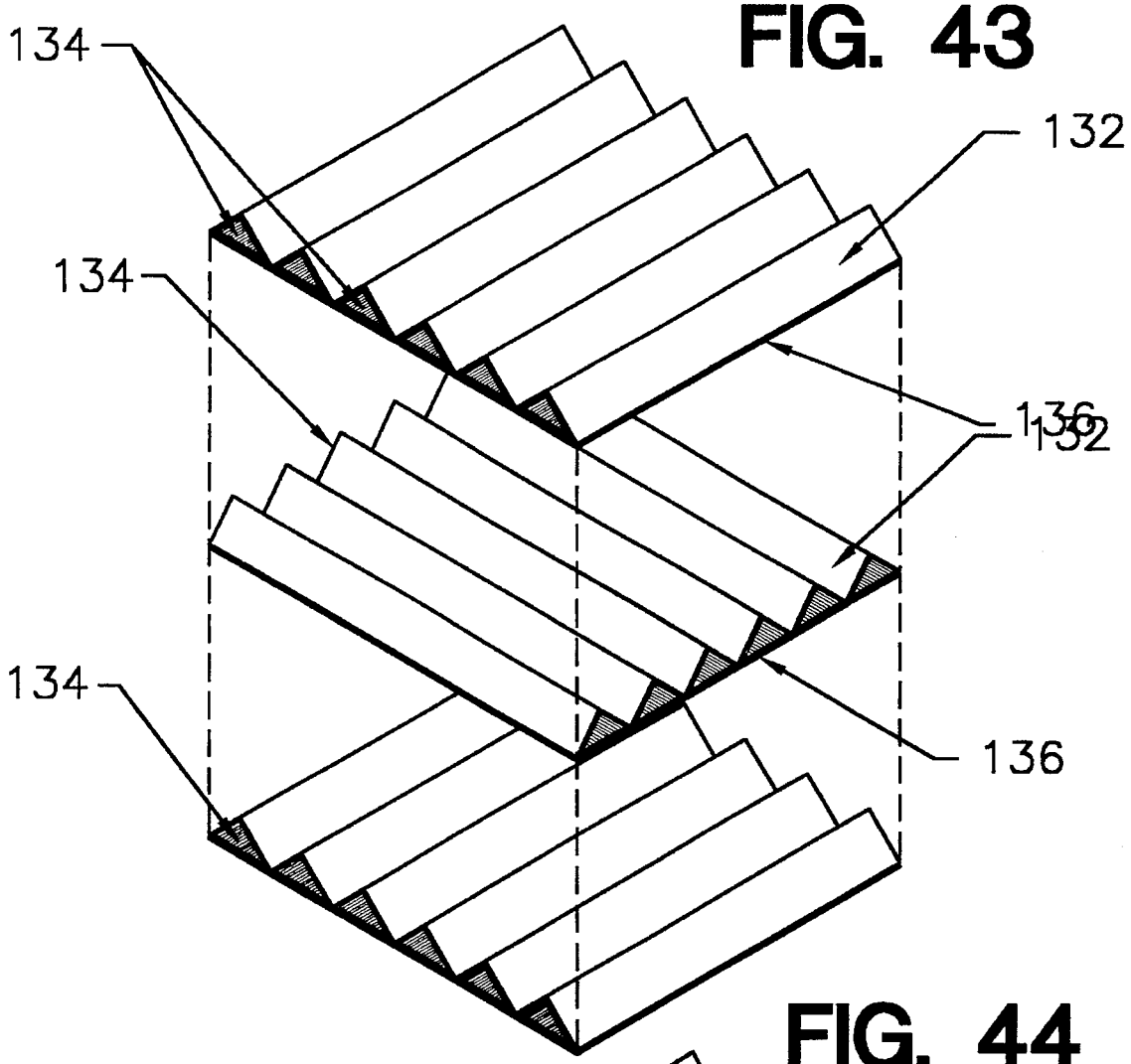
Figure 44:
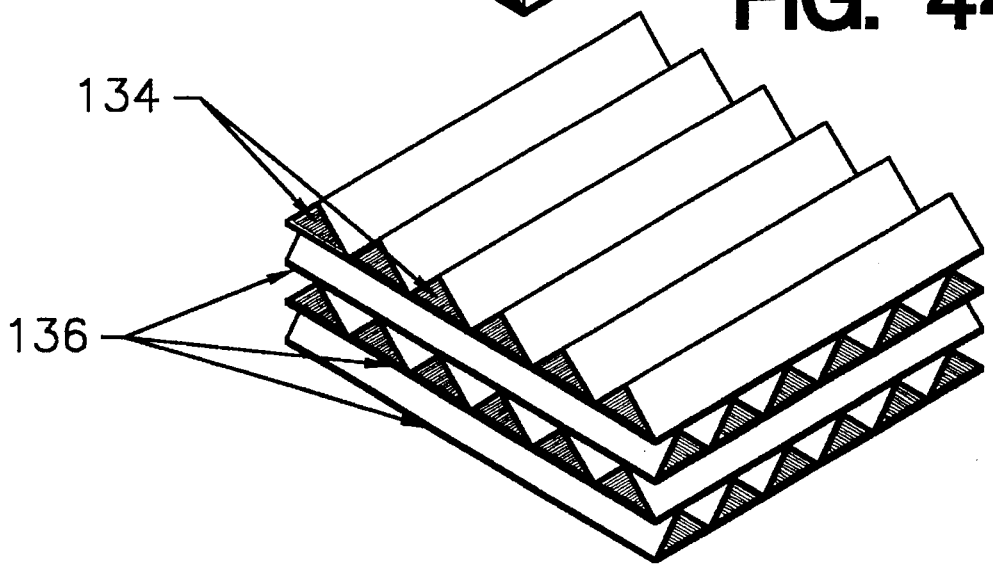
Figures 45, 46, 47:
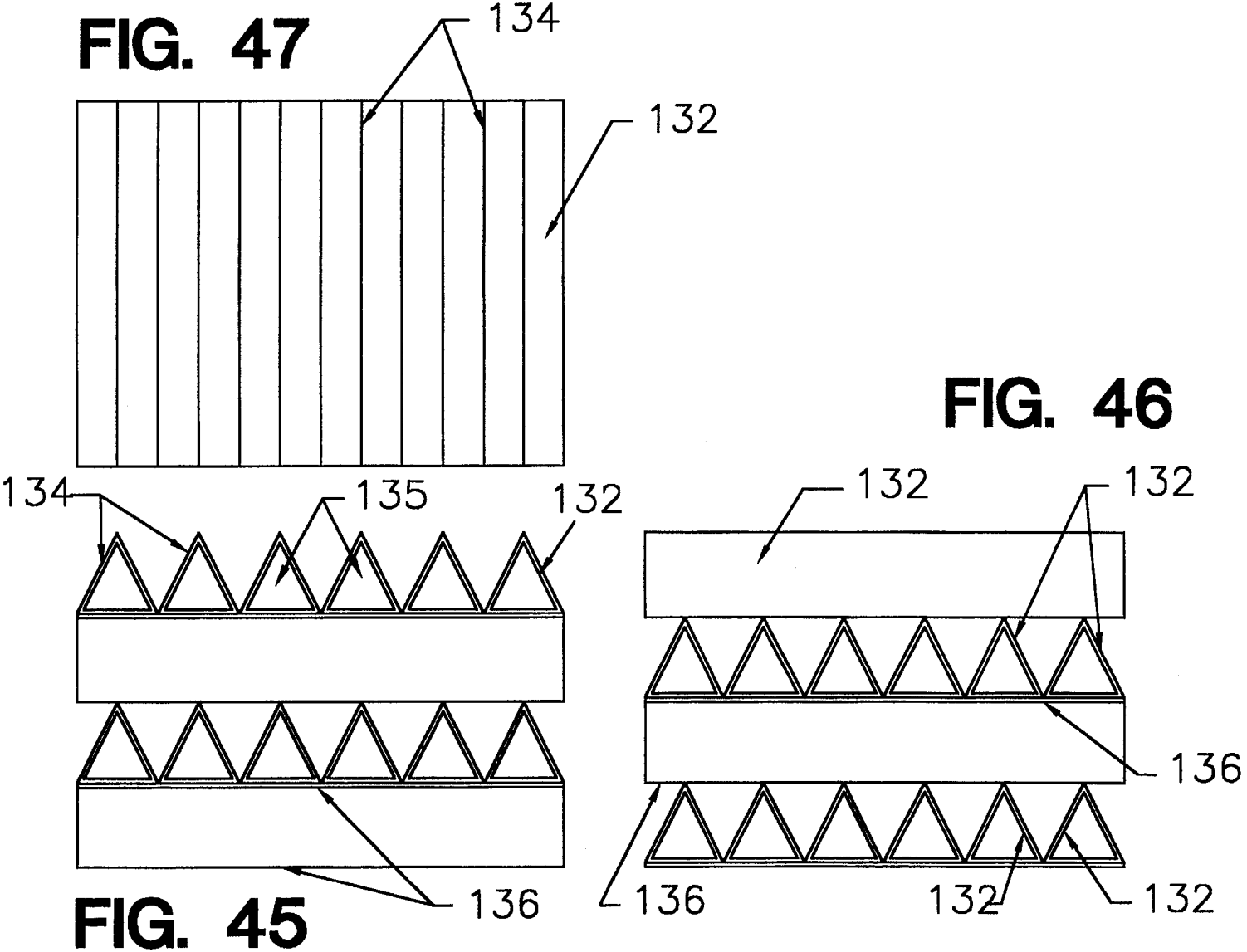

Lastly, a variation of the above embodiment is shown in FIGS. 43 through 47. In such last embodiment, the undulating sheets 132 are formed as spaced triangles 134. The triangles are secured as by an adhesive to planar sheets 136 to form lines or channels 135. The axes of the triangles of alternating sheets are at right angles to each other. Thus is defined a linear flow path for both the first and second fluids at right angles to each other as in the prior embodiments. Coupling components similar to those shown in FIGS. 31 and 32 are provided for coupling the heat exchangers with fluid flow lines, input and output, for both flows.

More specifically, the invention of the undulating embodiment relates to a conduit assembly for use in directing the flows of a primary fluid and a secondary fluid in heat exchanging relationship. Such assembly includes a fluid impervious planar member 124 and 136 and a coupling member 126 and 132 with undulations in spaced relationship one to an other and coupled along parallel linear extents to the planar member. The coupling member and planar member form laterally spaced fluid lines 120 and 135 with respect to each other to define between the ends thereof a plurality of linear first fluid paths from one end of the planar members to the other end of the planar members through a plurality of similar shaped channels peripherally bounded by the planar member and the undulations of the coupling member. Such assembly also coupling means to join together a plurality of conduits with alternating conduits having their channels in a common first direction defining the first path and with the remaining conduits having their channels in a common second direction perpendicular to the first path. First attachment means are provided for the coupled conduits at first opposite sides of the coupled conduits for the flow of a first fluid in a first fluid path, and second attachment means for the coupled conduits at second opposite sides of the coupled components for the flow of a second fluid in a second path. Consequently, when a primary fluid, preferably water, is fed through the first path at a first temperature and a second flow of fluid, preferably air, is fed through the second path at a second temperature, a heat transfer occurs therebetween.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A conduit for use in directing the flows of a primary fluid and a secondary fluid in heat exchanging relationship comprising, in combination:

a vertically positionable elongated member having long parallel side edges and short parallel upper and lower end edges, and generally parallel exterior faces therebetween, the elongated member being formed of two similarly configured parts of similar construction permanently coupled around their peripheries;

a header aperture extending through the member from face to face adjacent to the upper end edge;

a footer aperture extending through the member from face to face adjacent to the lower end edge;

the apertures having planar parallel peripheral surfaces at opposing ends at a first predetermined distance, the planar peripheral surfaces being attachable with planar peripheral surfaces of other similarly configured elongated members to define a first flow path for the primary fluid;

a plurality of essentially parallel coupling linear extents securing together the parts between the header aperture and the footer aperture to define parallel linear paths for the primary fluid moving in the first path from the header to the footer aperture, the parts being secured together along the coupling lines and their peripheries whereby the exterior surfaces of the facing parts are at a second predetermined distance less than the first predetermined distance; and spacer members formed in the exterior surfaces of the facing parts and extending outwardly to a distance whereby when a plurality of elongated members are coupled at their apertures, spaces will be formed between the exterior surfaces of the coupled elongated members to define a second path for the second fluid perpendicular to the first path for the first fluid so that when a first fluid of a first temperature is flowed in the first path and a second fluid of a second temperature is flowed in the second path, a heat exchange will occur therebetween.

2. A conduit for use in directing the flows of a primary fluid and a secondary fluid in heat exchanging relationship comprising:

an elongated member having long parallel side edges and short parallel end edges, and exterior faces therebetween;

a header aperture extending through the member from face to face adjacent to a first end;

a footer aperture extending through the member from face to face adjacent to a second end;

the apertures having associated peripheral surfaces at a first predetermined distance to define a first flow path for the primary fluid;

the elongated member having internally thereof a plurality of essentially parallel lines between the header aperture and the footer aperture to define flow paths for the primary fluid moving in the first path, the exterior surfaces of the member being at a second predetermined distance less than the first predetermined distance; and spacers formed with and extending outwardly from in the exterior surfaces of the members to define a second path for the second fluid perpendicular to the first path for the first fluid so that when a first fluid of a first temperature is flowed in the first path and a second fluid of a second temperature is flowed in the second path, a heat exchange will occur therebetween.

3. The apparatus as set forth in claim 2 wherein the lines between the header aperture and the footer aperture are linear and in a common plane.

4. The apparatus as set forth in claim 2 wherein the lines between the header aperture and footer aperture undulate.

5. The apparatus as set forth in claim 2 and further including supports at the end of the elongated members spring urging the header apertures and footer apertures of the elongated members away from each other.

6. The apparatus as set forth in claim 2 and further including projections on the exterior faces of the lines between the header apertures and footer apertures to maintain an appropriate spacing therebetween.

* * * * *